US005564528A

United States Patent [19]

Goto et al.

[11] Patent Number: 5,564,528

[45] Date of Patent: Oct. 15, 1996

[54] INWARD/OUTWARD DELIVERY DEVICE OF AUTOMATED WAREHOUSE

[75] Inventors: Yukihiro Goto, Inuyama; Yuso Ogawa, Iwakura, both of Japan

[73] Assignee: Daifuku Co., Ltd., Osaka, Japan

[21] Appl. No.: 293,727

[22] Filed: Aug. 22, 1994

[30] Foreign Application Priority Data

Feb. 7, 1994 [JP] Japan ..... 6-013043
Feb. 10, 1994 [JP] Japan ..... 6-015605

[51] Int. Cl.[6] ..... B66B 11/06

[52] U.S. Cl. ..... 187/261; 414/282

[58] Field of Search ..... 187/391, 394, 187/261, 244, 239, 406; 414/277–283

[56] References Cited

U.S. PATENT DOCUMENTS

| | | | |
|---|---|---|---|
| 3,184,083 | 6/1965 | Chasar | 414/282 |
| 3,542,161 | 11/1970 | Bronislaus | 187/394 |
| 3,887,038 | 6/1975 | Buschbom et al. | 187/239 |
| 4,015,686 | 4/1977 | Bushnell | 187/244 |
| 4,331,418 | 6/1982 | Klebe | 414/282 |
| 4,750,592 | 6/1988 | Watt | 187/394 |
| 5,129,484 | 7/1992 | Wagner | 187/244 |
| 5,188,199 | 2/1993 | Shirai | 187/95 |
| 5,226,782 | 7/1993 | Rigling | 414/281 |
| 5,281,070 | 1/1994 | Stolzer | 414/281 |
| 5,379,863 | 1/1995 | Sugawara et al. | 414/282 |
| 5,380,139 | 1/1995 | Pohjonen et al. | 414/278 |

FOREIGN PATENT DOCUMENTS

| | | | |
|---|---|---|---|
| 306302 | 6/1971 | Austria . | |
| 0546321A1 | 11/1992 | European Pat. Off. . | |
| 0581234 | 2/1994 | European Pat. Off. . | |
| 3020732A1 | 5/1980 | Germany . | |
| 0255114 | 3/1988 | Germany | 414/278 |
| 3837732C1 | 7/1988 | Germany . | |
| 4117857A1 | 5/1991 | Germany . | |
| 53-3529 | 7/1978 | Japan . | |
| 62-290609 | 2/1987 | Japan . | |
| 63-218406 | 9/1988 | Japan . | |
| 5-246509 | 9/1993 | Japan . | |
| 246509 | 1/1994 | Japan . | |
| 678310A5 | 6/1989 | Switzerland . | |
| 1055696 | 9/1984 | U.S.S.R. . | |
| 1213229 | 10/1968 | United Kingdom . | |

*Primary Examiner*—William E. Terrell
*Assistant Examiner*—T. Kelly
*Attorney, Agent, or Firm*—Barnes, Kisselle, Raisch, Choate, Whittemore & Hulbert, P.C.

[57] ABSTRACT

A force motivating a strut to incline itself in the running direction (front-and-rear direction) of a movable main body is produced by impact stress caused by accelerating, decelerating or stopping the operation of a delivery device. Such force can securely be received by a bottom frame structure as well as by a reinforcing structure of the portions of projected corner members protruding in the running direction which are formed integrally with a cylindrical body of the strut at respective corners thereof. A force motivating the strut to incline itself in the direction orthogonal to the running direction is produced by inward/outward load delivery operation by means of a delivery instrument provided on a carriage. Such force can also securely be received by the bottom frame structure as well as by the reinforcing structure of the portions of the projected corner members protruding in the orthogonal direction.

12 Claims, 18 Drawing Sheets

INWARD/OUTWARD DELIVERY DEVICE OF AUTOMATED WAREHOUSE

FIELD OF THE INVENTION

The present invention relates to an inward/outward delivery device of an automated warehouse, which is installed in a factory and capable of freely travelling on a predetermined route in front of corresponding shelves for example.

BACKGROUND OF THE INVENTION

There is such an automated warehouse consisting of a plurality of shelves and an inward/outward delivery device like the one presented by Japanese Laid-Open Patent Application Publication No. 63-218406 (1988), which uses a crane functioning as an inward/outward delivery device having a pair of front and rear struts or a single strut erected on a bottom frame or a truck in conjunction with an elevating carriage guided to said strut(s).

Each strut has square cylindrical transverse section and a groove-shaped guide rail in the center of front-rear line or right-left line. In addition, each strut has a plurality of L-shaped plates projecting themselves to the left and to the right or in the forward and backward directions, where these L-shaped plates extend themselves from respective corners. In order to fix parts, a rail groove is formed in respective L-shaped plates. Each strut is composed of an integrally extruded member having transverse section with symmetrically arranged front-rear and right-left formation.

When introducing a pair of struts for example, those double struts set to front and rear positions are erected on a bottom frame by orienting the guide rail in the front-rear direction, i.e., in the running direction. Next, a guide roller is brought into contact with any surface that faces the elevating carriage side (i.e., in the front-rear direction) among those surfaces forming the guide rail part, where the guide roller prevents front-rear-directional swing from the elevating carriage from occurrence. At the same time, another guide roller is brought into contact with a pair of surfaces positioned on both sides, where the latter guide roller prevents right-left-directional swing from the elevating carriage from occurrence.

On the other hand, when introducing a single strut, the guide rail is erected on a truck in the right-left direction. Next, a guide roller is brought into contact with a pair of surfaces facing the front-rear direction among those surfaces forming the guide rail part, where the guide roller prevents front-rear-directional swing from the elevating carriage from occurrence At the same time, another guide roller is brought into contact with a surface facing the right-left direction, where the latter guide roller prevents right-left-directional swing from the elevating carriage from occurrence.

However, when introducing the double struts according to the above exemplified prior art, since the L-shaped plates project themselves solely in the right-left direction, these L-shaped plates are by no means instrumental to reinforce the double struts in the front-rear direction. In consequence, these struts are apt to tilt themselves in the front-rear direction whenever accelerating or decelerating or discontinuing operating movement of the crane. Likewise, when introducing a single strut to the above structure, since the L-shaped plate projects itself solely in the right-left direction, the L-shaped plate is by no means instrumental to reinforce the strut in the right-left direction. In consequence, the single strut is apt to tilt itself in the right-left direction whenever delivering products into and out of a warehouse by operating a projected fork of a forklift truck.

Furthermore, since the direction of the single strut and the double struts must compulsorily be shifted by 90 degrees from each other, error easily occurs while erecting the struts on the bottom frame or the truck, and yet, much labor and time must be spent before completing the strut-erecting work.

Another exemplified structure is presented by Japanese Patent Publication No. 53-3529 (1978) for example. Concretely, a shelf-loading lift functioning as a delivery device is equipped with a double-barrel winding machine secured thereto by projecting itself from external surface of a vertical frame. A suspension rope being wound or unwound via rotation of each drum of the double-barrel winding machine is swingably separated into front and rear parts by means of an upper pulley set to an upper frame and then interlinked with each guide frame of a loading platform. The above-cited double-barrel winding machine causes each barrel to pivot on the right-left-directional axis.

Nevertheless, according to the structure of the above-cited prior art, the suspension rope extended from the upper pulley to respective barrels is positioned by way of externally being exposed along external surface of the vertical frame. Thus, it not only generates rather poor appearance, but it also causes maintenance operator to easily come into contact with the suspension rope to incur potential hazard. To dispose of this problem, there is an idea to pass the suspension rope through a vertical cylindrical frame and then draw out the rope from the cylindrical frame body at the position of the double-barrel winding machine. However, when executing this method, cutout portion must be provided for the rope-extracting position. This in turn involves troublesome processing steps and causes strength to decrease, and yet, much labor and time must be spent to pass the suspension rope through the cylindrical frame body.

Furthermore, since each barrel has substantial length in the right-left direction and long distance from the upper pulley, the suspension rope swings itself by a wide amplitude to the left and to the right while being wound and unwound, thus generating problem in terms of security. Conventionally, such a suspension rope is composed of a plurality of wires impregnated or adhered with oil, and thus, when the rope swings, oil easily scatters to cause peripheral regions to be stained.

Furthermore, there is another structure for guiding upper part of a crane exemplified in Japanese Laid-Open Patent Application Publication No. 62-290609 (1987). According to this prior art, a warehouse crane is movably supported by a guide-rail unit installed on floor surface. An overhang member is provided by way of extending itself in the horizontal direction from an upper frame. A pair of vertical shaft roller functioning to inhibit swing motion and nipping an upper guide-rail unit from both sides are pivotally supported on the overhang member in such a state without upwardly projecting itself from the upper surface of the upper frame. In addition, a guide plate is also provided, which incorporates a recess for accommodating the upper guide rail unit for engagement therewith.

According to the structure of the above-exemplified art, upper surface of the upper frame can be brought to a position closest to a ceiling surface or a beam member that supports the upper guide rail. In addition, the above structure can promote storage efficiency of the operating warehouse by minimizing vertical-directional dead space including the upper frame. Furthermore, even in the event that the above-referred vertical shaft roller functioning to inhibit swing motion ever falls off, the crane can securely be prevented from falling to the left or to the right by virtue of proper engagement of recessed domain of the guide plate with the upper guide rail unit.

Nevertheless, according to the structure of the above exemplified art, since the center position of the crane is not coincident with the center of the guide rail unit, in other words, since the centers of the crane and the guide rail unit significantly deviate from each other in the right-left direction, when stopper action is generated as a result of forcible contact of the swing-motion-inhibiting vertical shaft roller with the upper guide rail unit caused by biased load took place while delivering products into and from a warehouse by protruding a load transferring means in the lateral direction, the crane itself may incur distortion by effect of dispersed force. In addition, when stopper action is generated, substantial bending moment may act upon connecting part (joint portion) of the overhang member to break off the connection. If the connecting part were torn off, the guide plate will totally lose own function to prevent the crane from falling off.

Furthermore, there is such a structure for guiding lower part of a crane exemplified in Japanese Laid-Open Patent Application Publication No. 5-246509 (1993). According to this prior art, a delivery device is supportedly guided to a floor rail unit via drive wheels, follower wheels, and guide wheels. A detectable object having a detectable surface oriented to lateral direction is installed on the floor rail unit. A running-movement-controlling detection device is secured to the bottom of the delivery device, where the delivery device can freely face the detectable object from lateral side. According to this structure, products can be delivered from the delivery device to corresponding shelves or vice versa by combining travelling movement of the delivery device running on a predetermined route along front surface of shelves with vertical movement of an elevator and forward/backward movement of a delivery tool in lateral direction. Travelling movement of the delivery device can be controlled by causing the detection device to detect the object of detection.

Nevertheless, according to the structure of the above-exemplified art, detectable surface of the detectable object projects in the external lateral direction from lateral surface of the upper plate on the floor rail. This in turn permits dust of worn elements of wheels to easily deposit on the detectable surface to stain the detectable surface to consequently lower detection precision, thus eventually failing to correctly and stably control the whole system operation including travelling movement of the delivery device. Once such defect occurs, it will cause wheels of the other side to float themselves from floor rails by way of availing either side of front and rear wheels as supporting point while the delivery device accelerates or decelerates own moving speed or travels at a high speed or stops own movement in case of emergency. In an extreme case, wheels of the delivery device may run off from the floor rails or the delivery device may overturn itself.

DISCLOSURE OF THE INVENTION

It is an object of the invention to provide a novel delivery device usable for an automated warehouse, wherein either a single strut or a pair of struts provided for the delivery device can sufficiently reinforce both the front-rear direction and the right-left direction even when introducing single-strut formation or double-strut formation, and yet, each strut according to the invention can easily be erected in the identical direction independent of the strut formation introduced.

It is another object of the invention to provide a novel delivery device usable for an automated warehouse, wherein installation of wires along struts can easily and safely be implemented by way of generating neat appearance, wherein each wire can be wound and unwound by generating minimum amplitude of swing in the right-left direction, wherein impregnated oil can be prevented from splashing over periphery of the wire system, and wherein struts can easily and firmly be erected independent of single-strut formation or double-strut formation introduced therefor.

It is a still further object of the invention to provide a novel delivery device usable for an automated warehouse, wherein the delivery device contains minimal vertical-direction dead space and prevents itself from falling down to the left and to the right, wherein, when stopper action is activated, the delivery device can guide upper part of the movable main body via a ceiling rail without dispersing force, wherein the delivery device can securely prevent itself from falling down even when guide rollers are broken, and wherein the delivery device can prevent detectable surface of detectable object from incurring stain independent of installation environment, and yet, quickly cope with floating of own wheels.

To achieve the above objects, the invention provides a novel delivery device usable for an automated warehouse, wherein a movable main body is structured by integrating a bottom frame structure with a single strut or double struts, wherein a carriage unit capable of freely moving in the vertical direction is provided along one of front and rear surfaces of struts, wherein each strut comprises a cylindrical body having rectangular cross-section, a plurality of projected corner rods projecting themselves outside of front-rear and right-left domains from respective corners of the rectangular cylindrical body, and a projected center rod projecting itself outside of the front-rear direction on external surface of the front-rear direction of the rectangular cylindrical body, wherein the rectangular cylindrical body, the projected corner rods, and the projected center rod, are integrally molded into a strut unit.

According to the structure of the invention, the delivery device can execute inward and outward delivery of products onto and from corresponding shelves by driving the movable main body and by lifting and lowering the carriage. By virtue of provision of a reinforcing structure using the above-referred projected corner rods projecting themselves in the front-rear direction from the rectangular cylindrical body of the strut, force causing the strut to tilt in the front-rear direction generated by shock at the moment of acceleration, deceleration, and stopping the movement of the delivery device can securely be received by the bottom frame structure. In addition, by virtue of provision of a reinforcing structure using the projected corner rods projecting themselves in the right-left direction from the cylindrical body of the strut, force causing the strut to tilt in the right-left direction can securely be received by the bottom frame structure when executing inward or outward delivery of products into or from a warehouse by operating a delivery tool on the carriage in the right-left direction. In this way, each strut can be erected on the bottom frame structure without being tilted in the front-rear and right-left directions.

According to an aspect of an embodiment of the invention, the rectangular cylindrical body consists of a pair of long-side members facing each other and another pair of short-side members facing each other by way of forming rectangular cross-section. Using a pair of short-side members for composing the front-rear-directional external surface, each strut is erected on a bottom frame structure.

According to the above embodiment, since long-side members of the rectangular cylindrical body is disposed in the front-rear direction, availing of their substantial length, force causing the struts to tilt themselves in the front-rear direction generated by shock at the moment of acceleration, deceleration, and stopping the movement of the delivery device can more securely be received by the bottom frame structure.

According to an aspect of another embodiment of the invention, a single strut is erected on the bottom frame structure, wherein a pair of swing-preventive rollers on the part of a carriage are contactably disposed against a surface facing a side opposite from the carriage side of the above-referred projected corner rods and against a surface facing the carriage side of the single strut.

According to the above embodiment, by causing the swing-preventive rollers to come into contact with a surface facing a side opposite from the carriage side of the projected corner rods and a surface facing the carriage side of the strut, even when being guided by a single strut, vertical-directional movement of the carriage can be executed very smoothly without accidentally swinging itself in the front-rear direction, and in addition, the projected corner rods can be used to serve as guide of the swing-preventive rollers.

According to an aspect of a still further embodiment of the invention, each strut is integrally molded into symmetric formation in the front-rear and right-left directions.

According to this embodiment, independent of the single or double strut formation, each strut can be erected on the bottom frame structure without necessarily minding about orientation by 90 degrees or 180 degrees. In other words, each strut can be erected merely by aligning the long-side members in the front-rear direction on the way of assembly work. Concretely, each strut can easily be erected on the bottom frame structure in the identical direction merely by aligning the long-side members in the front-rear direction.

To achieve the above objects, the invention provides a novel delivery device usable for an automated warehouse, wherein the delivery device comprises a bottom frame structure, a movable main body consisting of a single strut or double struts vertically erected on the bottom frame structure, and a vertically movable carriage unit disposed on a surface of the strut in the front-rear direction which is substantially the travelling direction of the movable main body. A drive unit for driving an elevating unit is installed to lower part of the other side of one of the erected struts. A wire unit extended from the elevator drive unit is linked with a carriage unit via an upper roller secured to the upper part of the movable main body, wherein a vertical-directional groove is formed at least on the other side of said strut, and wherein a lower guide roller is secured to an upper part of the elevator drive unit in order that the wire engaged between the upper and lower guide rollers can be positioned inside of the vertically formed groove provided for the front and rear domains.

According to the structure embodied by the invention, the wire extended from the elevator drive unit is initially engaged with the lower guide roller from the strut side and then installed inside of the groove from external side. The wire is then engaged with the upper guide roller from the top side, and then, vertically extended downward before eventually being linked with the carriage to complete the wire installing process. The carriage is lifted and lowered by initially transmitting shifting force to the wire via winding or unwinding of the wire to permit the upper guide roller to guide shifting movement of the wire. While the carriage is lifted or lowered, the wire is arranged to shift itself inside of the front-rear groove between the upper and lower guide rollers.

According to an aspect of the above embodiment of the invention, the elevator drive unit incorporates a rotatable drum in the periphery of right-left directional axis being orthogonal to the front-rear direction. The wire from the drum is linked with the carriage via the upper guide roller installed to the upper part of the movable main body, whereas the lower guide roller is so arranged that it can freely shift in the direction along the right-left directional axis.

According to the above embodiment, the above-referred drum is rotated in the clockwise or counterclockwise direction in the periphery of the right-left directional axis. This causes the wire to be wound or unwound via rotation of the drum in either direction and receive shifting force to activate lifting or lowering movement of the carriage. While the carriage ascends or descends, the lower guide roller reciprocates itself in the right-left direction. In consequence, it prevents the wire from sharply swinging itself between the upper and lower guide rollers. In addition, this also makes it possible to execute helicoidal winding of the wire onto the drum and the unwinding therefrom.

According to an aspect of the above embodiment, a bearing unit is installed between the lower guide roller and the supporting shaft thereof, wherein the bearing unit permits the lower guide roller to reciprocate itself in the direction along the right-left directional axis by applying lateral-directional force of the wire generated on the way of winding the wire onto the drum and unwinding the wire therefrom. A concealing cover is secured to the strut in order to externally conceal the wire in a range from the lower guide roller to the elevator drive unit. This in turn creates neat appearance on both sides and in the front-rear direction of the strut when externally viewing the strut structure. Furthermore, the concealing cover prevents the wire from coming into contact with warehouse operators and any of those which are handled in the operating site, and yet, the cover securely receives oil scattered from the wire. Another cover is also secured to the strut side in order to externally conceal the groove. Since the wire shifts itself inside of the groove in a range from the upper guide roller to the lower guide roller while the carriage ascends or descends, and in addition, since the cover conceals external portion of the groove, both the wire and the groove are fully concealed when viewing the lateral sides and the front-rear sides of the strut, thus creating neat appearance of the whole strut structure. In this way, provision of concealing covers prevents warehouse operators and those which are handled in the operating site from coming into contact with the wire and associated mechanism, and yet, oil scattered from the travelling wire can securely be received by the concealing covers and the strut structure.

According to an aspect of a preferred embodiment of the invention described above, the bottom frame structure has a plurality of wheels respectively being supported and guided by a floor rail unit. The elevator drive unit consists of a drum facing the strut and a drive unit secured to an end of a right-left-directional side in opposition from the drum. A travel drive unit linked with the travelling wheels is secured to an end of the other right-left-directional side in opposition from the drum.

According to this embodiment, even when the movable main body is about to tilt itself after being affected by suspending force of the wire unit, because of substantial load generated by the travel drive unit secured to the other side of the drive mechanism, part of the tilting force is offset, thus permitting the movable main body to smoothly and stably continue own travelling operation.

According to another aspect of the above embodiment, each strut has rectangular cross section. A pair of right-left-directional front and rear grooves are formed in the upper and lower direction on the other side of the strut. In addition, left and right grooves are formed in the upper and lower direction on both sides of the right-left direction. A pair of right-left-directional guide surfaces are formed by means of left and right surfaces of a pair of front-rear grooves in order to prevent the strut from swinging itself to the left and to the right. Likewise, a pair of front-rear-directional guide surfaces are formed by means of front-rear-directional surfaces of the right-left grooves in order to prevent the strut from swinging itself back and forth. The right-left-directional guide surfaces and the front-rear-directional guide surfaces are respectively formed in corner domains which are respectively formed in rectangular rod members.

According to the above embodiment, up and down movement of the carriage can be performed very smoothly without generating accidental swing owing to smooth guidance via the right-left-directional guide surfaces respectively inhibiting right-left-directional swing and the front-rear-directional guide surfaces respectively inhibiting front-rear-directional swing. Furthermore, even when the carriage strongly hits against the right-left-directional guide surfaces or the front-rear-directional guide surfaces, by virtue of reinforcing structure of the rectangular rod members, the carriage can securely be prevented from incurring unwanted bending.

To achieve the above objects, the invention provides a novel delivery device usable for an automated warehouse, wherein the delivery device comprises a bottom frame structure, a movable main body consisting of a single strut or double struts erected on the bottom frame structure-, and a carriage unit which is capable of freely ascending and descending itself and movably disposed to one-side surface of the strut along front-rear direction corresponding to the travelling direction of the movable main body. An elevator drive unit is secured to the lower part of the other side surface of the erected strut in order to wind and unwind a plurality of wire units. These wires extended from the elevator drive unit are respectively wound on a plurality of right-left-directional guide wheels secured to the upper part of the movable main body, and then the wires are interlinked with the carriage. The guide wheels are discretely disposed to the left and to the right by way of traversing the center of the movable main body. Clearance enough to internally accommodate a ceiling rail unit is formed between the guide wheels disposed to the left and to the right. In addition, a pair of left and right guide rollers for nipping the ceiling rail unit and members for accommodating the ceiling rail unit are respectively secured to the upper part of the movable main body.

According to the invented structure described above, since the center of the movable main body correctly matches the center of the ceiling rail unit, work for installing the delivery device can easily be implemented. Since the upper guide rollers are properly guided to both-side surfaces of the ceiling rail unit, the movable main body can stably move on itself without fear of incurring overturn. For example, even when stopper action is generated as a result of forceful collision of guide rollers with the ceiling rail caused by biased load on the way of performing inward or outward delivery of products, since the upper guide rollers are properly guided to the ceiling rail from both sides, and yet, since the center of the ceiling rail correctly matches the center of the movable main body, impact force generated by collision solely concentrates onto the centers of the ceiling rail unit and the movable main body without being dispersed, and therefore, the movable main body rarely incurs unwanted distortion.

When stopper action is generated, no substantial bending moment acts upon connector part (joint portion) of a pair of fall-preventive members, and thus, there is no fear of breaking off the connection. Therefore, even when the upper guide rollers are accidentally broken off, the fall-preventive members respectively come into contact with both sides of the ceiling rail, thus securely preventing the movable main body from falling down itself to the left or to the right. Furthermore, since the ceiling rail is positioned between the left and right guide wheels, these guide wheels can safely run themselves without fear of coming into collision or contact with the ceiling rail. At the same time, installed wires are smoothly shifted along both sides of the ceiling rail without coming into collision or contact with it.

According to an aspect of the above embodiment, a pair of struts are disposed in the front-rear direction, where the upper ends of the two struts are linked with each other by means of an upper frame structure. A carriage is installed between both struts. A pair of left and right wire units are wound on a pair of base-side right and left guide wheels secured to the upper frame structure on the side of an elevator drive unit. One of the right and left wire units is then linked with the carriage, whereas the other wire unit is wound on a guide wheel on the idler side of the upper frame structure on the side apart from the elevator drive unit. Then, the latter wire unit is also linked with the carriage. Clearance is formed between two base-side guide wheels. The idler-side guide wheel is installed on the other side across the center of the movable main body.

According to the above embodiment, since the ceiling rail is positioned between a pair of base-side guide wheels and at one side of the idler-side guide roll, the delivery device can smoothly travel itself without causing any of the guide wheels to come into collision or contact with the ceiling rail. Ascending or descending operation of the carriage is performed by way of guiding the moving wires via respective guide wheels. The wires can smoothly be conveyed along both external sides of the ceiling rail without coming into collision or contact with the ceiling rail.

According to another embodiment of the invention described above, each of the fall-preventive members is provided with a pair of guide rollers aligned to the left and to the right. In this embodiment, by virtue of securing the fall-preventive members to the upper part of the movable main body, the right and left guide rollers can be installed simultaneously with precision. In addition, when stopper action is generated, no substantial moment acts upon the connector parts of the fall-preventive members respectively having a pair of guide rollers, thus eliminating fear of breaking off the connection.

To achieve the above objects, the invention provides a novel automated warehouse comprising a plurality of shelves each accommodating a plurality of storage rooms and a delivery device capable of freely running on a predetermined route in front of these shelves in the manner supportedly being guided on a floor rail via plural wheels, wherein the floor rail has I-shaped cross section, wherein a plurality of detectable objects having detectable surfaces oriented to one side are set to a lateral surface of a web, wherein one side of an upper frame structure is projectively formed by way of projecting itself beyond a range in which detectable objects are aligned, wherein a detection device for controlling running operation of the delivery device and a plurality of fall-preventive rollers capable of freely coming into contact with the projective flange from the bottom side are respectively provided below the delivery device, wherein the running-control detection device can freely face detectable surfaces of respective detectable objects from lateral position.

According to the invented structure described above, by way of cooperatively combining running operation, inward/outward delivery operation, and ascending/descending operation of the carriage unit, with each other, the delivery device can deliver products into and out:of objective storage rooms of corresponding shelf. Since travelling wheels of the delivery device are supportedly guided on the upper surface of an upper flange structure, the delivery device can stably and smoothly perform running operation. Running operation of the delivery device such as disconnection from:high-or-medium speed run or stop of running operation at a predetermined position can controllably be executed by enabling a detection device to detect detectable surfaces of respective detectable objects.

Since a projected flange is positioned above detectable surfaces of detectable objects and further outside of one ends of the detectable surfaces, dust of worn elements of travelling wheels and dust fell down from the top of the automated warehouse can hardly adhere to the detectable surfaces of detectable objects, in other words, detectable surfaces can hardly be stained with dust. As a result, detectable surfaces of detectable objects can maintain clean condition for a long while, thus enabling the detection device to precisely detect detectable surfaces throughout detecting operation. In consequence, operation of the whole system including operation of the delivery device can stably be controlled with precision.

In the event that either side of the travelling wheels is about to float themselves from the floor rail because of impact force caused by acceleration, deceleration, high-speed run, or sudden stop of the delivery device in case of emergency, a plurality of fall-preventive rollers disposed nearby the travelling wheels quickly come into contact with the projected flange to prevent wheels from floating upward, thus securely preventing all the wheels of the delivery device from being disengaged from the floor rail and the delivery device itself from incurring overturn.

According to an aspect of the embodiment of the invention described above, a plurality of downwardly extending rod members are secured to peripheral edge of the projected flange. The downwardly extended rod members set to periphery of the projected flange securely prevent dust on the peripheral domain of the projected flange from directly falling onto detectable surfaces of the detectable objects. In other words, dust can hardly gain access to detectable surfaces of the detectable objects.

According to an aspect of the embodiment of the invention described above, peripheral edge of the projected flange externally protrudes further from peripheral edge of the bottom flange structure. Owing to this structural arrangement, dust passed by peripheral edge of the projected flange can hardly fall on the bottom flange structure nor deposit thereon. In consequence, this structural arrangement securely prevents dust from adhering onto detectable surfaces of detectable objects otherwise caused by suspending of dust from the upper surface of the bottom flange structure.

DESCRIPTION OF THE PREFERRED EMBODIMENTS

Referring now to FIGS. 1 through 8, structural detail of the delivery device according to the first embodiment of the invention is described below.

Figure 1:
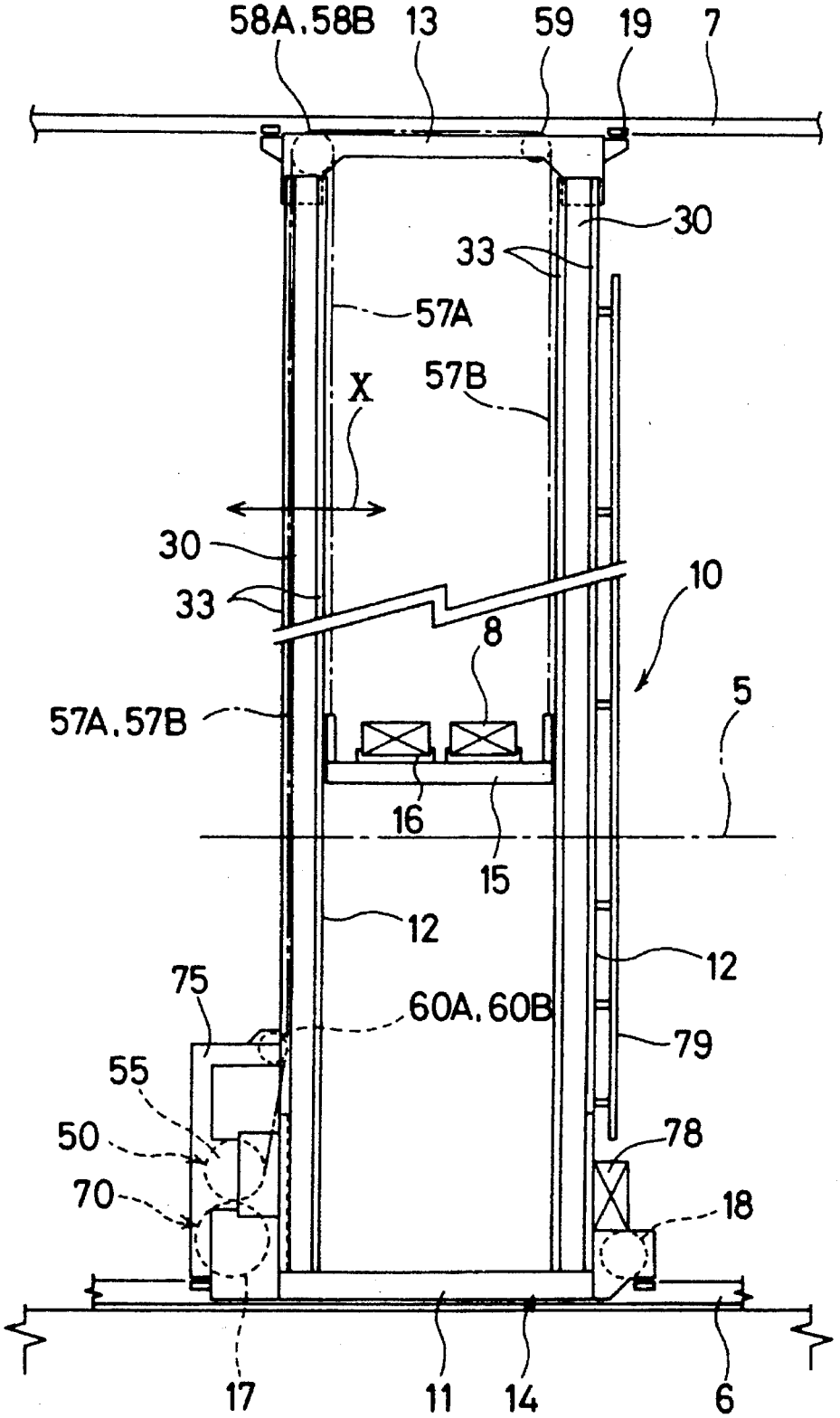
FIG. 1 is a partially exposed lateral view of the delivery device usable for an automated warehouse according to the first embodiment of the invention.
Figure 2:
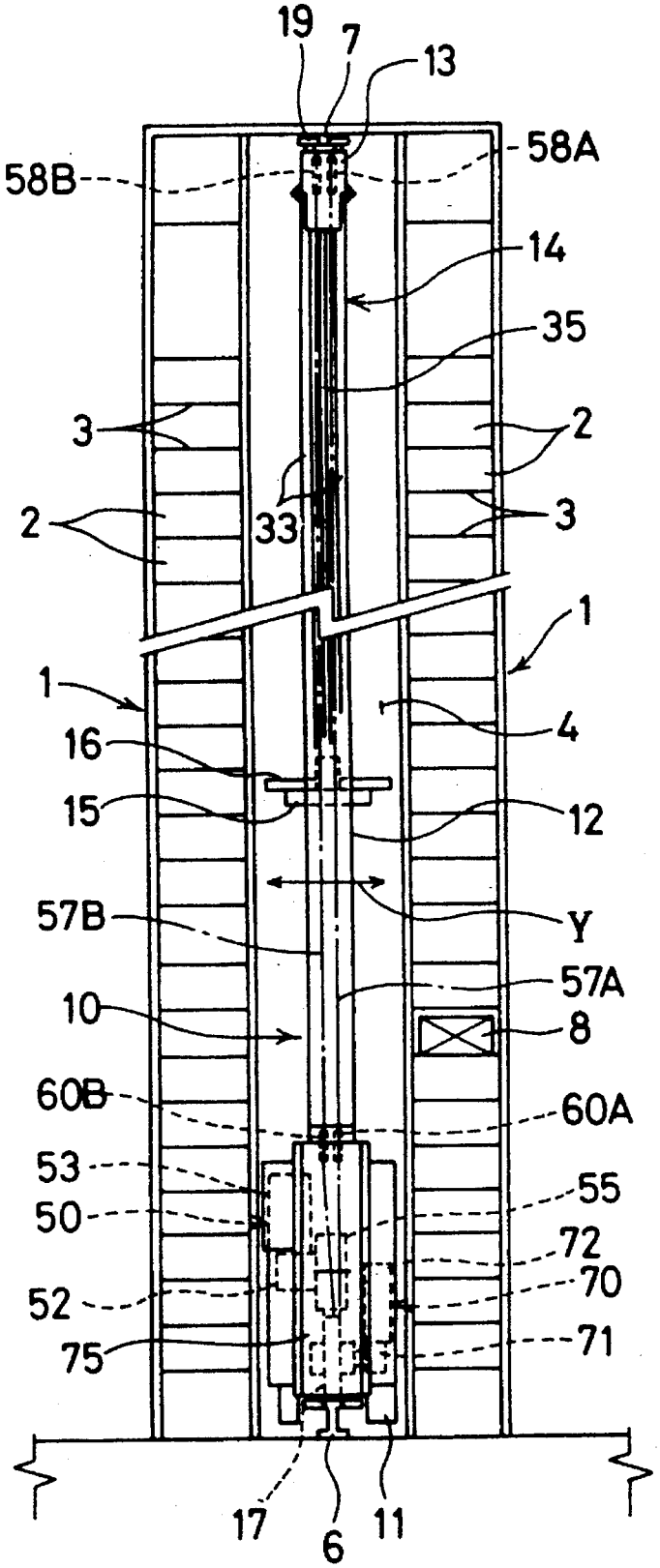
FIG. 2 is a partially exposed front view of the delivery device usable for an automated warehouse shown in FIG. 1.
Figure 3:
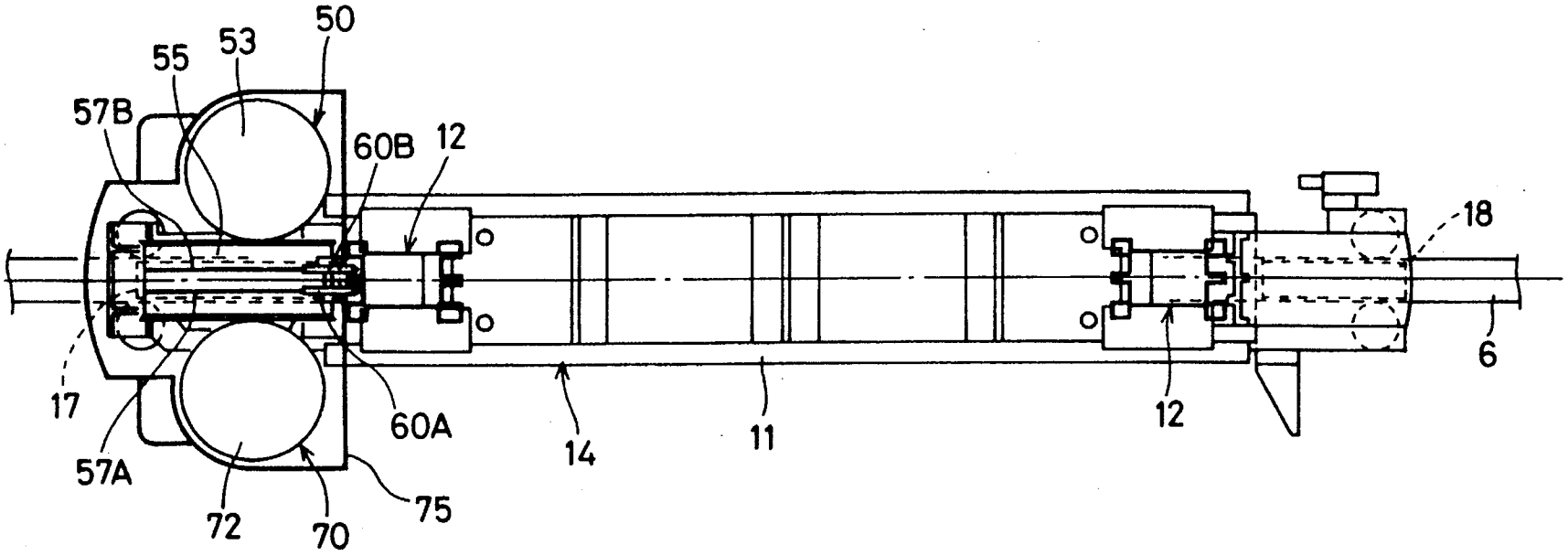
FIG. 3 is a plan of a bottom frame structure of the delivery device usable for an automated warehouse shown in FIG. 1.

As shown in FIGS. 1 and 2, a plurality of storage rooms 2 are provided in the vertical and horizontal directions inside of framed shelves 1 and 1. Each storage room 2 is structured in order that it can directly store load via brackets 3 or pallets. These shelves 1 and 1 are disposed in parallel with each other across a passageway 4 in which an inward/outward delivery device 10 is disposed by way of freely travelling itself on a predetermined route 5.

A movable main body 14 is provided for the delivery device 10. The movable main body ]4 structurally consists of a bottom frame unit 11, a pair of struts 12 erected on the bottom frame unit 11 in the front-rear direction X, in other words, in the travelling direction, and an upper frame unit 13 interlinking tip ends of these struts 12. A carriage 15 is disposed between these struts 12 by way of freely ascending and descending itself. In addition, a delivery tool 16 such as a fork and/or a conveyer attached with a stopper means is disposed on the carriage 15 in order to execute inward/outward delivery of load to and from respective storage rooms 2.

A drive wheel (travelling wheel) 17 and a follower wheel (travelling wheel) 18 respectively being held and guided by a floor rail 8 are discretely disposed in the front-rear direction X in the structure of the bottom frame unit 11. A pair of right-left-directional guide rollers 19 guided by a ceiling rail are discretely disposed in the front-rear direction X in the structure of the upper frame unit 13.

Figure 7:
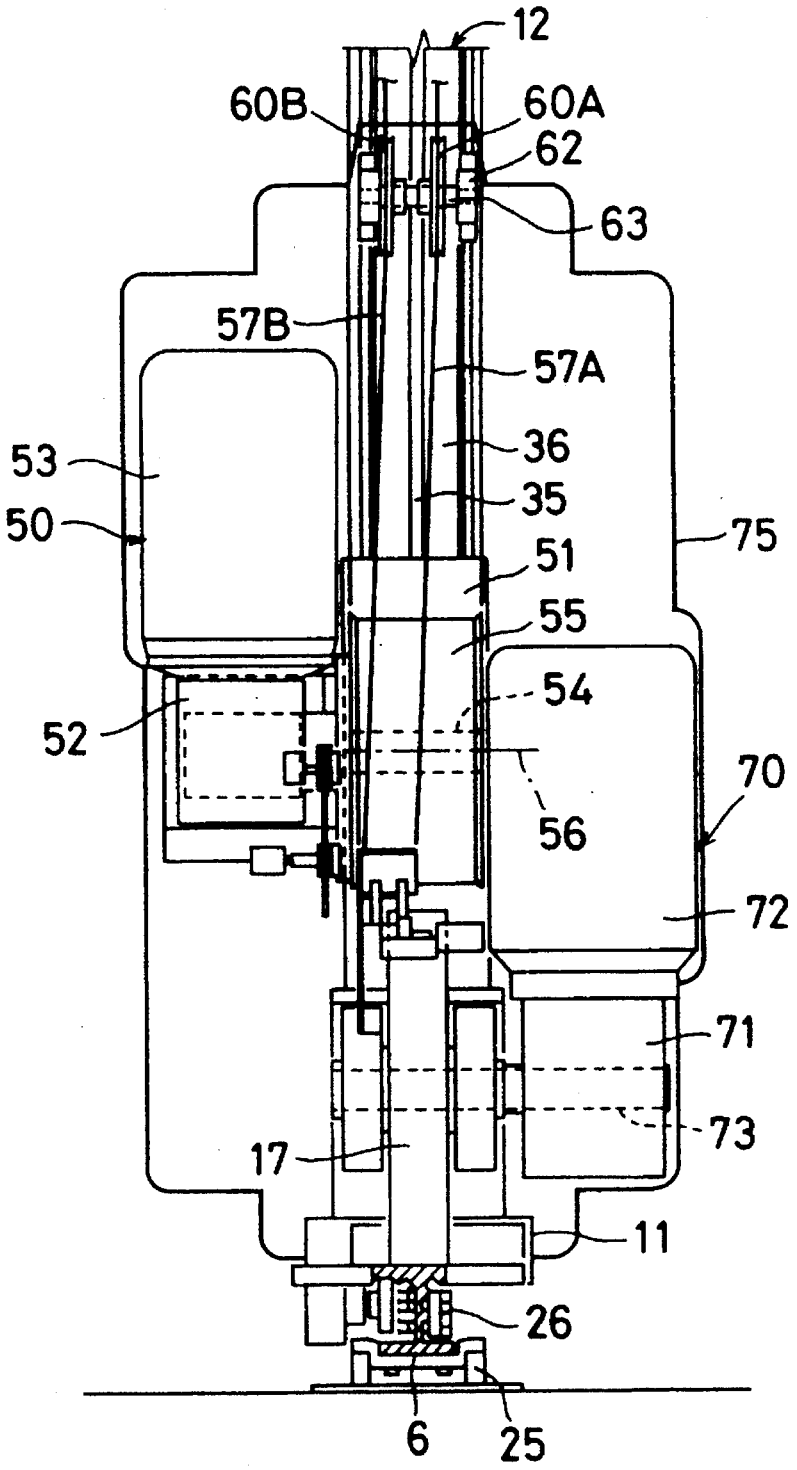
FIG. 7 is a front view of the elevator drive unit of the delivery device usable for an automated warehouse shown in FIG. 1.

As shown in FIG. 7, the floor rail 8 has I-shaped cross section, which is secured to floor via a fixture member 28 that acts upon a lower flange unit. A pair of control rails 28 are installed on both-side surfaces of a web portion in order that power can be supplied and signal can be transmitted and received therethrough.

Figure 5:
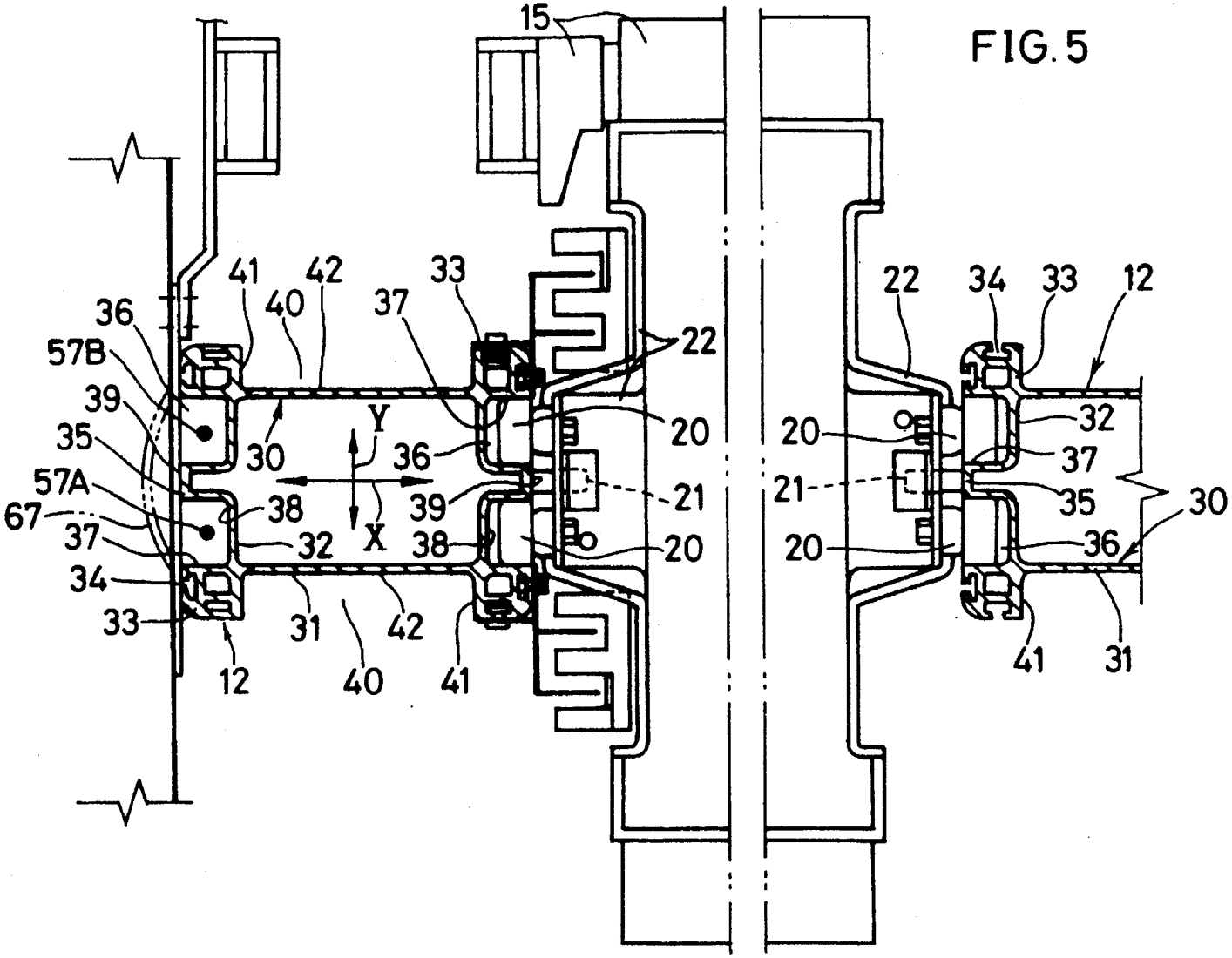
FIG. 5 is a cross-sectional plan of strut mechanism of the delivery device usable for an automated warehouse shown in FIG. 1.
Figure 6:
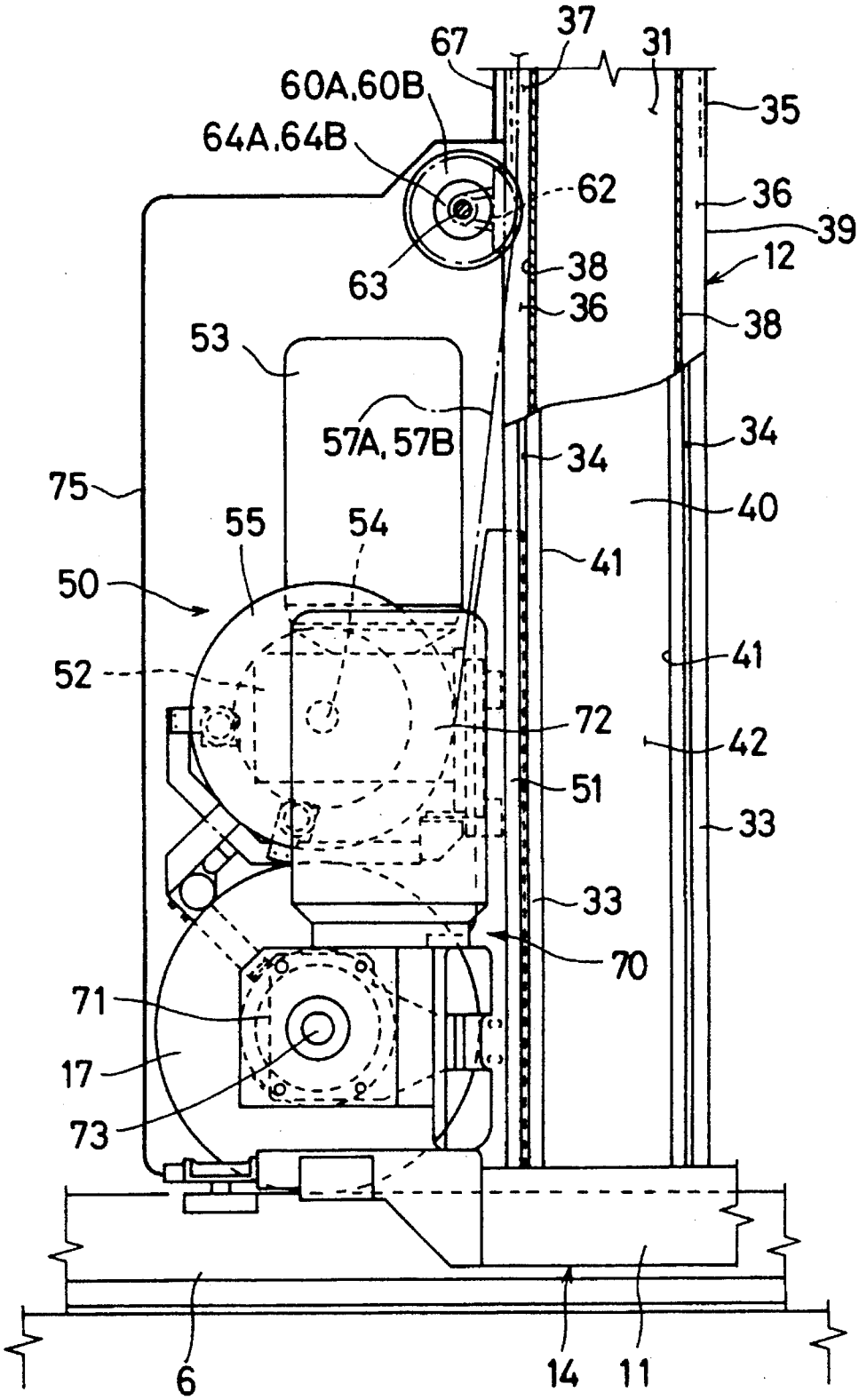
FIG. 6 is a partially exposed lateral view of an elevator drive unit provided for the delivery device usable for an automated warehouse shown in FIG. 1.

Each strut 12 is integrally molded by extruding aluminium for example. As shown in FIG. 5, a pair of front-rear-directional struts 12 are erected without selecting direction, where each strut 12 has a cross section being symmetrical in the front-rear and right-left directions.

Concretely, the integrally molded strut 12 comprises the following; a cylindrical body 30 having rectangular cross section, a plurality of projected corner rods 33 outwardly projecting themselves in the front-rear and right-left directions from four corners, and a plurality of projected center rods 85 outwardly projecting themselves in the front-rear direction X from the center of the right-left direction Y on the front-rear-directional external surfacers of the rectangular-sectional cylindrical body 30. The rectangular-sectional cylindrical body 30 consists of a pair;of long-side members 31 facing each other in the right-left direction Y and a pair of short-side members 32 facing each other in the front-rear direction. A pair of struts 12 are respectively erected on the bottom frame unit 11 in the front-rear direction X by setting a pair of short-side members 32 to form the front-rear-directional external surfaces.

The projected corner rods 33 are respectively of rectangular shape. A plurality of dovetail grooves 34 for interlinkage with peripheral components are respectively formed in the latitudinal direction on the foremost external surfaces of respective rods 33 in the front-rear direction X and the right-left direction Y. The projected center rods 35 respectively have rectangular cross section, which are respectively formed in the state being folded from the right-left-directional centers of the short-side members 32 and externally projecting themselves in the front-rear direction X, where inner space of respective rods 35 is interlinked with inner space of the cylindrical body 30.

Using a pair of right-left-directional projected corner rods 33 and a pair of projected center rods 35, a pair of front-rear grooves 36 are formed in the right-left direction Y by way of vertically being formed on both side surfaces (on a surface and on the other surface) corresponding to the front-rear direction X. The right and left surfaces for forming the front-rear grooves 36 are respectively formed on right-left-directional external guide surfaces 37 available for inhibiting right-left-directional swing. On the other hand, front-rear-directional surface (facing the carriage 15) of the cylindrical body 30 available for forming the front-rear grooves 36 is formed on the first external front-rear-directional guide surface 38 available for inhibiting front-rear directional swing. On the other hand, front-rear directional surface (facing the carriage 15) of the projected center rods 35 is formed on the second external front-rear-directional guide surface 39 available for inhibiting front-rear-directional swing.

Using a pair of front-rear-directional corner rods 33, a pair of right-left grooves 40 are formed in latitudinal direction on both surfaces (in the right-left direction Y) of the strut 12. Internal surfaces (being opposite from the carriage 15 and in the front-rear direction X) of the right-left grooves are respectively formed on internal front-rear-directional guide surfaces 41 available for inhibiting front-rear-directional swing. On the other hand, external surfaces (in the Y) of the right-left grooves 40 are respectively formed on internal right-left-directional guide surfaces 42 available for inhibiting right-left-directional swing.

As described above, availing of the cylindrical body 30, the first external front-rear-directional guide surfaces 38 and the internal right-left-directional guide surfaces 42 are respectively formed on the strut 12, wherein, availing of the projected corner rods 33, the external right-left-direction guide surfaces 37 and the internal front-rear-directional guide surfaces 41 are respectively formed, and wherein, availing of the projected center rods 35, the external right-left-directional guide surfaces 37 and the second external front-rear-directional guide surfaces 39 are respectively formed.

On the part of the carriage 15, a pair of the right-left-directional rollers 20 (for inhibiting right-left-directional swing) to be guided onto the external right-left-directional guide surfaces 37 and a plurality of front-rear-directional swing inhibiting rollers 21 to be guided onto the second external front-rear-directional guide surfaces 39 are respectively installed to plural locations in the latitudinal direction via corresponding brackets 22. In consequence, the right-left-directional swing inhibiting rollers 20 secured to both sides jointly nip the projected center rods 35 along the right-left direction Y. The above swing-inhibiting rollers 20 and 21 are respectively made from flexible resin such as polyurethane resin for example.

As shown in FIGS. 1 through 3 and 6 through 8, an elevator drive unit 50 is installed to one-side of the lower frame structure 11, in other words, to the lower part of a surface of one of the double struts 12. The elevator drive unit 50 winds and unwinds a pair of wire units. The drive unit 50 comprises the following; a support body 51 secured to the lower part of a surface of one of the double struts 12, a reduction gear unit 52 secured to the support body 51, a vertically erected motor unit 53 (incorporating flange-type brake) installed above the reduction gear unit 52 via linkage therewith, and a cantilever drum 55 secured to an output shaft 54 extended from the reduction gear unit 52. The drum 55 is opposite from one of the double struts 12 and freely rotatable in the periphery of right-left-directional axis 56 (axis of the output shaft) orthogonal to the front-rear direction X. Both the reduction gear unit 52 and the motor unit 53 are respectively disposed to one side of the right-left direction Y against the drum 55.

Wire winding surface of the drum 55 is divided into two parts in the right-left direction Y so that a pair of wires consisting of the first wire unit 57A and the second wire unit 57B can respectively be wound on and unwound from the two discrete parts in which hericoidal wire guide grooves are formed based on a predetermined pitch.

Figure 4:
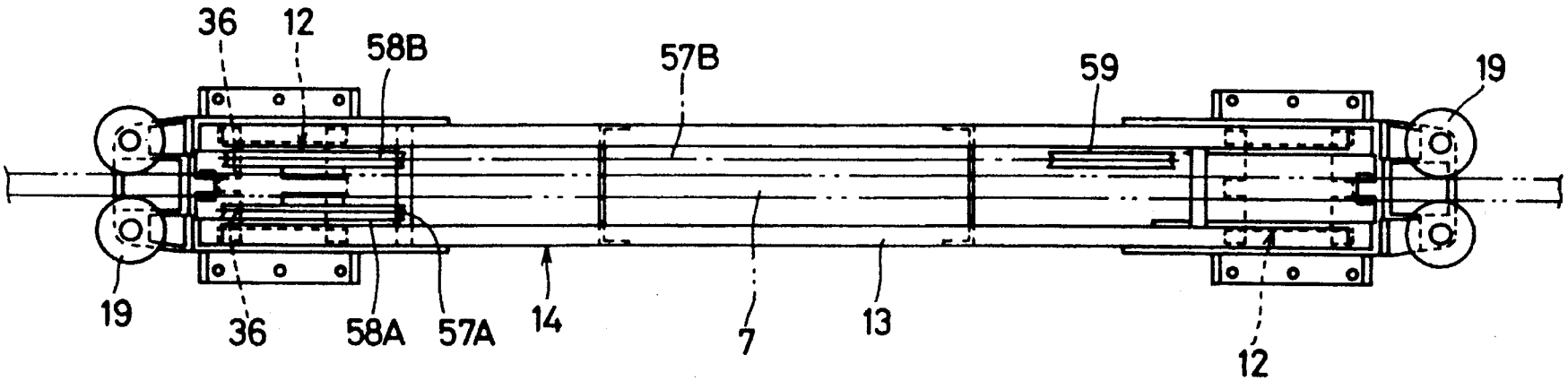
FIG. 4 is a plan of an upper frame structure of the delivery device usable for an automated warehouse shown in FIG. 1.

The wire units 57A and 57B are elongated upward, and then, as shown in FIGS. 1, 2, and 4, both wire units are wound on a pair of large-diametral upper guide wheels 58A and 58B secured to an edge portion of the upper frame structure 13. After being drawn downward, the first wire unit 57A is linked with an end portion of the carriage 15. Initially, the second wire unit 57B is wound on a small-diametral upper guide wheel 59 secured to the other end of the upper frame structure 13, and then, after being drawn downward, the second wire unit 57B is linked with the other end of the carriage 15.

As shown in FIGS. 1 through 3 and 6 through 8, a pair of lower guide wheels 60A and 60B are installed above and close to the elevator drive unit 50. A pair of right-left brackets 62 are secured to the strut via a pair of bolt nuts acting upon a pair of dovetail grooves 34. A support shaft 63 along the right-left-directional axis 56 is secured between the right and left brackets 62.

A pair of lower guide wheels 60A and 60B are externally coupled with the support shaft 63 in the right-left direction Y via a pair of bearings 64A and 64B. The bearings 64A and 64B respectively cause the lower guide wheels 60A and 60B to freely rotate themselves, and yet, cause these guide wheels 60A and 60B to automatically reciprocate themselves in the direction along the right-left-directional axis 56 by applying lateral-directional force of the wire units 57A and 57B generated while winding or unwinding these wires 57A and 57B via the drum 55. The bearings 64A and 64B respectively comprise core metal 65A and 65B respectively being secured to the lower guide wheels 60A and 60B and stroke ball bearings 66A and 66B respectively being interposed between the core metals 65A and 65B and the support shaft 63.

The lower guide wheels 60A and 60B are respectively so disposed that peripheral domains of the lower guide wheels 60A and 60B on the part of the strut 12 can discretely protrude into a pair of front-rear grooves 36. As shown in FIG. 5 with virtual lines and in FIG. 6, a plate cover 67 externally concealing the front-rear grooves 36 accommodating the wire units 57A and 57B is secured on the part of the strut 12. The cover 67 is secured to the strut 12 with fixing means that acts upon the dovetail grooves 34.

As shown in FIGS. 1 through 3 and 6 and 7, a running drive unit 70 linked with the drive wheel 17 is secured to lower part of an end of the lower frame structure 11, in other words, to lower part of a surface of one of the double struts 12. The running drive unit 70 concurrently serves as the support body 50 described above, wherein the drive unit 70 comprises a reduction gear units 71 secured to the support body 51 and a vertically erected drive means such as a motor (incorporating flange-type brake) secured onto the reduction gear unit 71 in linkage therewith. The drive unit 70 is secured to the other side of the right-left direction Y against the drum 55.

A box-form cover unit 75 is secured to one of the struts 12 with fixture means acting upon the dovetail grooves 34. The box-form cover unit 75 not only externally conceals the wire units 57A and 57B in a range from the lower guide wheels 60A and 60B to the elevator drive unit 50, but it also externally conceals the elevator drive unit 50 and the running drive unit 70 as well. The reference numerals 78 and 79 respectively designate a controller unit and a ladder.

Referring to FIGS. 1 through 8, systematic operation of the delivery device according to the first embodiment is described below.

In the course of assembling the delivery device, each strut 12 can readily be erected on the bottom frame structure 11 without particularly minding the way of orientation to be 90 degrees or 180 degrees, but the struts 12 can be erected merely by aligning the long-side members 31 in the front-rear direction X. The carriage 15 is disposed between the double struts 12 by coupling the right-left-directional swing-inhibiting rollers 20 with the front-rear grooves 36 and by enabling the front-rear-directional fall-preventive rollers to come into contact with the second external front-rear-directional guide surface 39.

A pair of wire units 57A and 57B are respectively installed to the strut structure after once removing the concealing covers 67 and 75 therefrom. Since the drum 15 is of open-sided form, the wire units 57A and 57B can easily be wound on the drum 55 via the open side, and yet, inspection and maintenance work can readily be executed via the open side of the drum 55. Next, the wire units 57A and 57B are discretely coupled with the lower guide wheels 60A and 60B from the strut side. Next, the wire units 57A and 57B are discretely installed in the front-rear grooves 36 from the outer side, and then the wires 57A and 57B are respectively engaged with the upper guide wheels 58A, 58B, and 59 from the top side. Then, the wires 57A and 57B are discretely elongated downward before being linked with the carriage 15. Finally, the concealing covers 67 and 75 are respectively secured to the original positions.

According to the structure of the delivery device, the elevator drive unit 50 and the running drive unit 70 are disposed on both sides in the right-left direction Y across the drum 55 of the elevator drive unit 50 in the vertical-directional arrangement. This in turn permits the delivery device 10 to contract own lateral width and front-rear-directional length.

Based on operating instructions transmitted via a running power unit (not shown), the delivery device 10 causes the movable main body 14 to run itself on a predetermined route 5 via the running drive unit 70 and also causes the delivery instrument 16 to reciprocate itself in the right-left direction Y. In addition, based on operating instructions transmitted via the elevating drive unit 50, the delivery device 10 also drives the carriage 15 in the vertical direction. By effectively performing these systematic operations in linkage with each other, the delivery device 10 can follow up inward/outward delivery of load 8 to and from an objective storage room 2 of the corresponding shelf 1.

While the movable main body 14 moves on, since the wheels 17 and 18 are supported and guided by the floor rail unit 6 and yet the guide rollers 19 are guided by the ceiling rail unit 7, the movable main body 14 can stably move on itself without fear of incurring overturn at all. Certain force motivating the struts 12 to tilt themselves in the front-rear direction X caused by shock occurring at the moment of acceleration, deceleration, and stopping movement of the delivery device 10 can securely be received by the bottom frame structure 22 in addition to reinforcing structure formed by means of the projected corner rods 33 projecting themselves in the front-rear direction X from the cylindrical body 30. Since the long-side members 31 of the cylindrical body 30 are disposed in the front-rear direction X, availing of sufficient length of the long-side members 31, stress to motivate the struts 12 to tilt themselves in the front-rear-direction X cam more securely be received. Thus, the struts 12 can stably be erected on the bottom frame structure 11 without fear of tilting themselves in the front-rear direction The carriage 15 is lifted and lowered by sequentially executing those serial operations described below. Initially, normal or reverse directional rotation of the elevator drive unit 53 is transmitted to the output shaft 54 via the reduction gear unit 52 to rotate the drum 55 in the normal or reverse direction, and then, availing of the normal-directional rotation or the reverse-directional rotation of the drum 55, the wires 57A and 57B are jointly wound on or unwound from the drum 55 to provide the wires 57A and 57B with movable force, and then, movement of the wires 57A and 57B are jointly transmitted to the carriage 15 via the upper guide wheels 58A and 58B to generate lifting or lowering movement of the carriage 15.

While the carriage 15 ascends or descends, a pair of right-left-directional swing preventive rollers 20 aligned on both sides are led to the right-left-directional guide surfaces 37 provided on both external sides, and then, a pair of front-rear-directional swing preventive rollers 21 are guided to the second external front-rear-directional guide surfaces 39. As a result, the carriage 15 can smoothly perform lifting or lowering operation without accidentally swinging itself under stable guidance of a pair of struts 12. Even when the right-left directional swing preventive rollers 20 forcibly hit against the right-left-directional guide surfaces 37 disposed outside of the right-left direction Y, by virtue of the reinforcing structure formed by rectangular rods of the projected corner-rod unit 33, distortion can hardly be generated.

In addition, stress that motivates the struts 12 to tilt themselves in the right-left direction Y at the moment of shifting the delivery instrument 16 in the right-left direction Y is securely received by the bottom frame structure 11 in addition to reinforcing structure formed by the projected corner rods 33 projecting themselves in the right-left direction Y from the cylindrical body 30 of the struts 12.

Since helicoidal wire-guiding grooves are formed on the drum 55, the wires 57A and 57B are wound on and unwound from the drum 55 so that the wires 57A and 57B in the innermost layer can be wound on or unwound from the drum 55 helicoidally and automatically. Owing to guidance via helicoidal surfaces formed by surface of the innermost wires, winding of the wires can be helicoidally and automatically executed from the second inner layer on. While the drum 55 winds or unwinds the wires 57A and 57B, lateral-directional stress is generated in local domains of the wires 57A and 57B close to the drum 55.

When lateral-directional stress is generated, the lower guide wheels 60A and 60B rotatably being supported by the bearing units 64A and 64B are respectively shifted to one side affected by lateral-directional stress via a pair of stroke ball bearings 66A and 66B. In other words, lateral-directional stress causes the lower guide wheels 60A and 60B to automatically reciprocate themselves in the direction along the right-left directional axis 56. In consequence, helicoidal winding and unwinding of the wires 57A and 57B onto and from the drum 55 can be executed smoothly without obstruction. Since the lower guide rollers 60A and 60B reciprocate themselves within width of the front-rear-directional grooves 36, local portions of the wires 57A and 57B corresponding to a position higher than the lower guide rollers 60A and 60B swing themselves in the right-left direction Y inside of the front-rear grooves 36.

While being lifted or lowered, the wires 57A and 57B respectively shift themselves inside of the front-rear grooves 36 in a range from the large-diametral upper guide wheels 58A and 58B to the lower guide wheels 60A and 60B. Since external side of the front-rear grooves 36 is fully concealed by a plate cover 67, the grooves 36 are totally invisible from all directions, thus generating neat appearance. Furthermore, the external plate cover 67 prevents operators and those which are located in peripheral locations from coming into contact with the internal mechanism, and yet, even the slightest amount of oil scattered out of the swingable wires 57A and 57B can securely be shielded by a box-form cover 75 and the struts 12.

Although the movable main body 13 is apt to tilt itself towards the elevator driver 53 of the elevator drive unit 50 because of suspension force of the wires 57A and 57B, part of tilting stress can be absorbed by load on the part of the running drive unit 70 disposed on the opposite side of the elevator driver 53.

According to the first embodiment of the invention thus far described, the elevator drive unit 50 and the running drive unit 70 are discretely installed on both sides in the right-left direction Y across the drum 55 secured to the center position. The invention however also provides such an embodiment for disposing the elevator drive unit 50 and the running drive unit 70 to optional locations.

According to the first embodiment, both the plate-form cover 67 and the box-form cover 75 have been introduced. Nevertheless, the invention also provides such an embodiment by way of dispensing with either of the plate-form cover 67 and the box-form cover 76 or the both. In the first embodiment, the lower guide rollers 60A and 60B are disposed so that they can freely reciprocate themselves in the right-left direction Y. However, the invention also provides such an embodiment by way of permitting the lower guide wheels 60A and 60B to solely rotate themselves around the supporting shaft 63 without being able to shift themselves in the right-left direction Y. Furthermore, in the first embodiment, the lower guide wheels 60A and 60B can freely and automatically reciprocate themselves in the right-left direction Y. However, the invention also provides such an embodiment to cause the lower guide wheels 60A and 60B to forcibly be shifted to the left and to the right.

Figure 9:
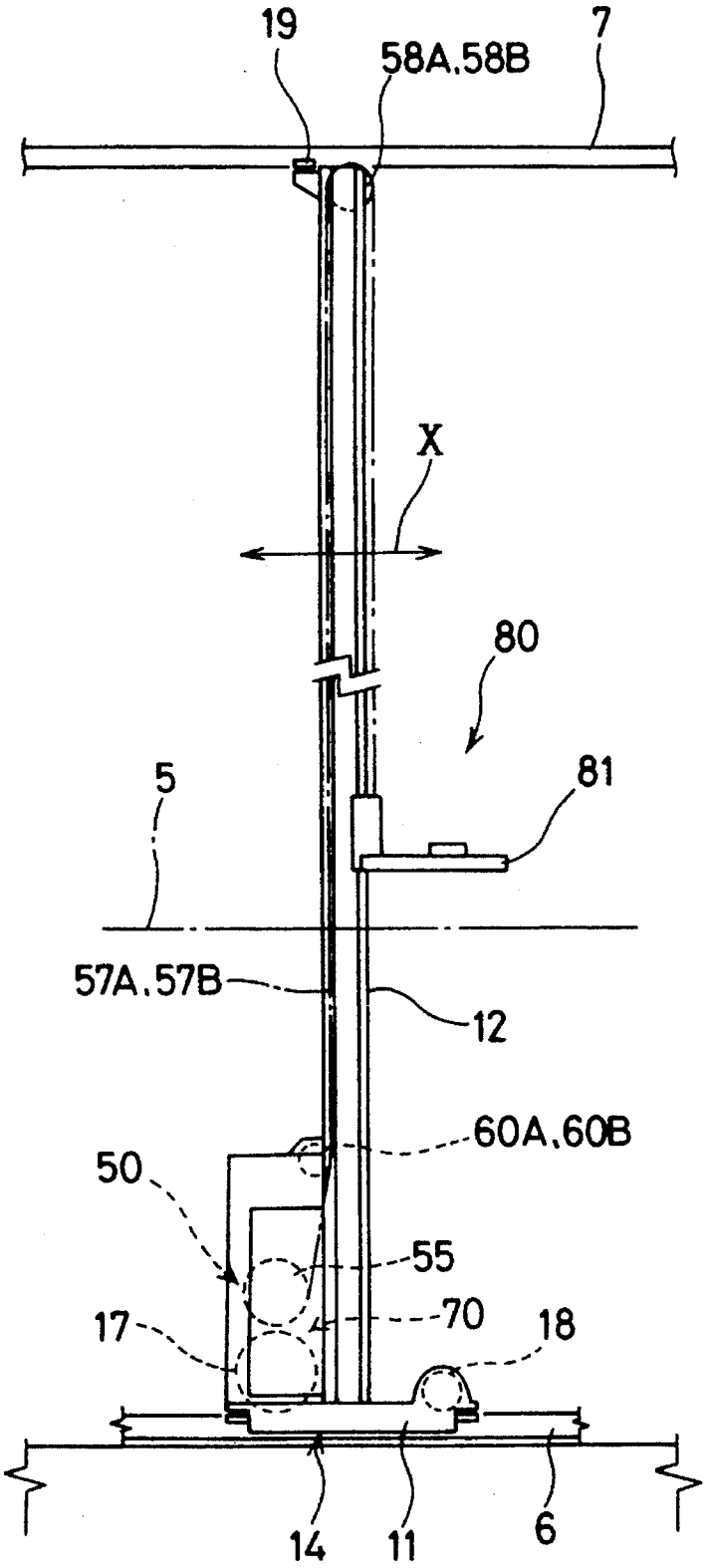
FIG. 9 is a partially exposed lateral view of the delivery device usable for an automated warehouse according to the second embodiment of the invention.
Figure 10:
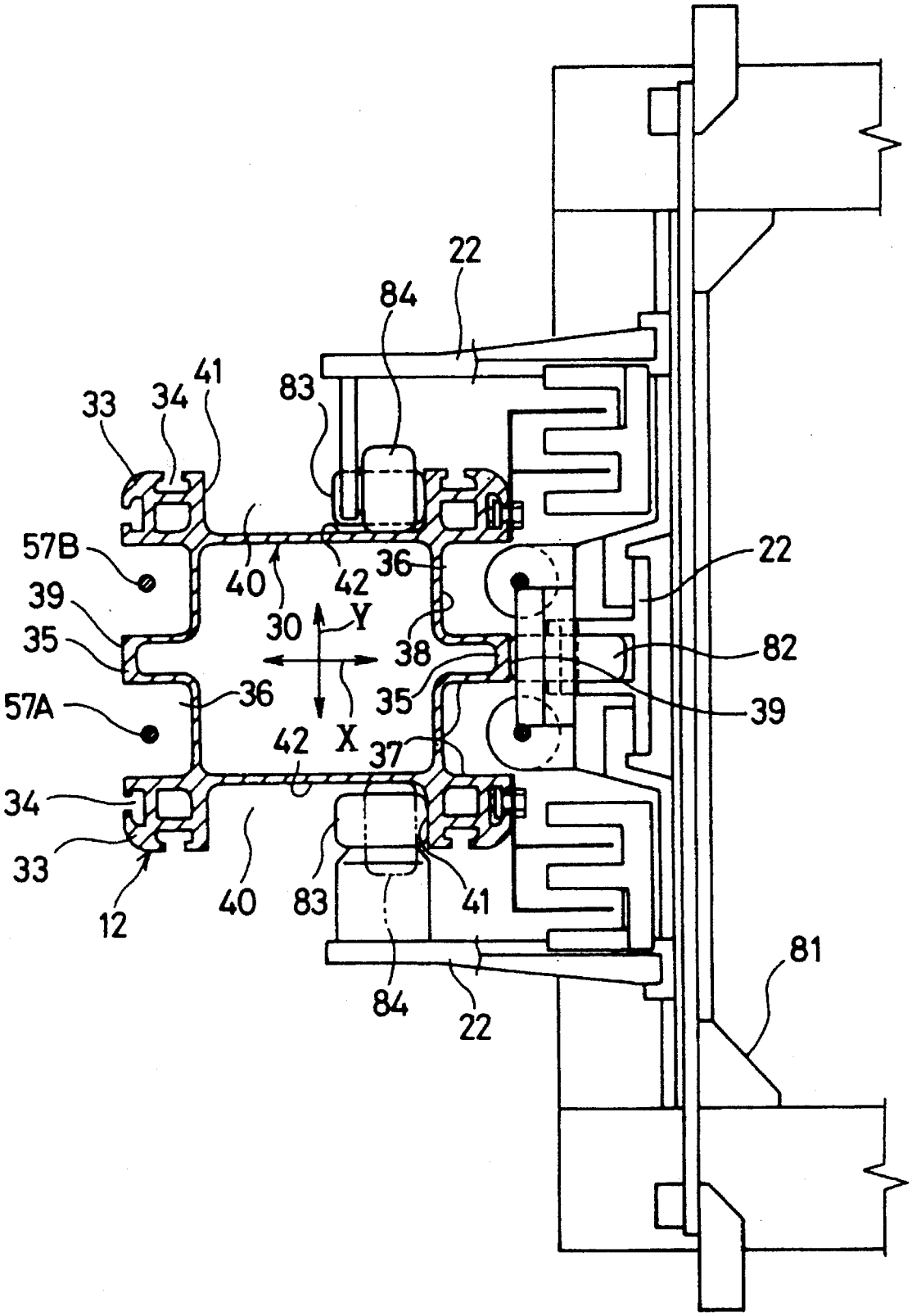
FIG. 10 is a cross-sectional plan of strut mechanism of the delivery device usable for an automated warehouse shown in FIG. 2.

FIGS. 9 and 10 respectively illustrate cross-sectional views of a delivery device 80 according to the second embodiment of the invention. According to the second embodiment, the delivery device 80 merely uses a single strut 12. The strut 12 is equipped with a square cylindrical body 30. A plurality of rollers are secured to plural locations on the part of a carriage 81 in the vertical direction including the following; an external front-rear-directional swing preventive roller 82 to be led to the second external front-rear-directional guide surface 39; a pair of internal front-rear-directional swing preventive rollers 84 disposed in the right-left direction Y, which are respectively to be led to a pair of internal front-rear-directional guide surfaces 41; and a pair of internal right-left-directional swing preventive rollers 84 disposed in the right-left direction Y, which are respectively to be led to a pair of internal right-left-directional guide surfaces 42. In the second embodiment of the invention, the single strut 12 is nipped by the front-rear-directional swing preventive rollers 82 and 83 along the front-rear direction X and also by the internal right-left-directional swing preventive rollers 84 along the right-left direction Y.

Figure 8:
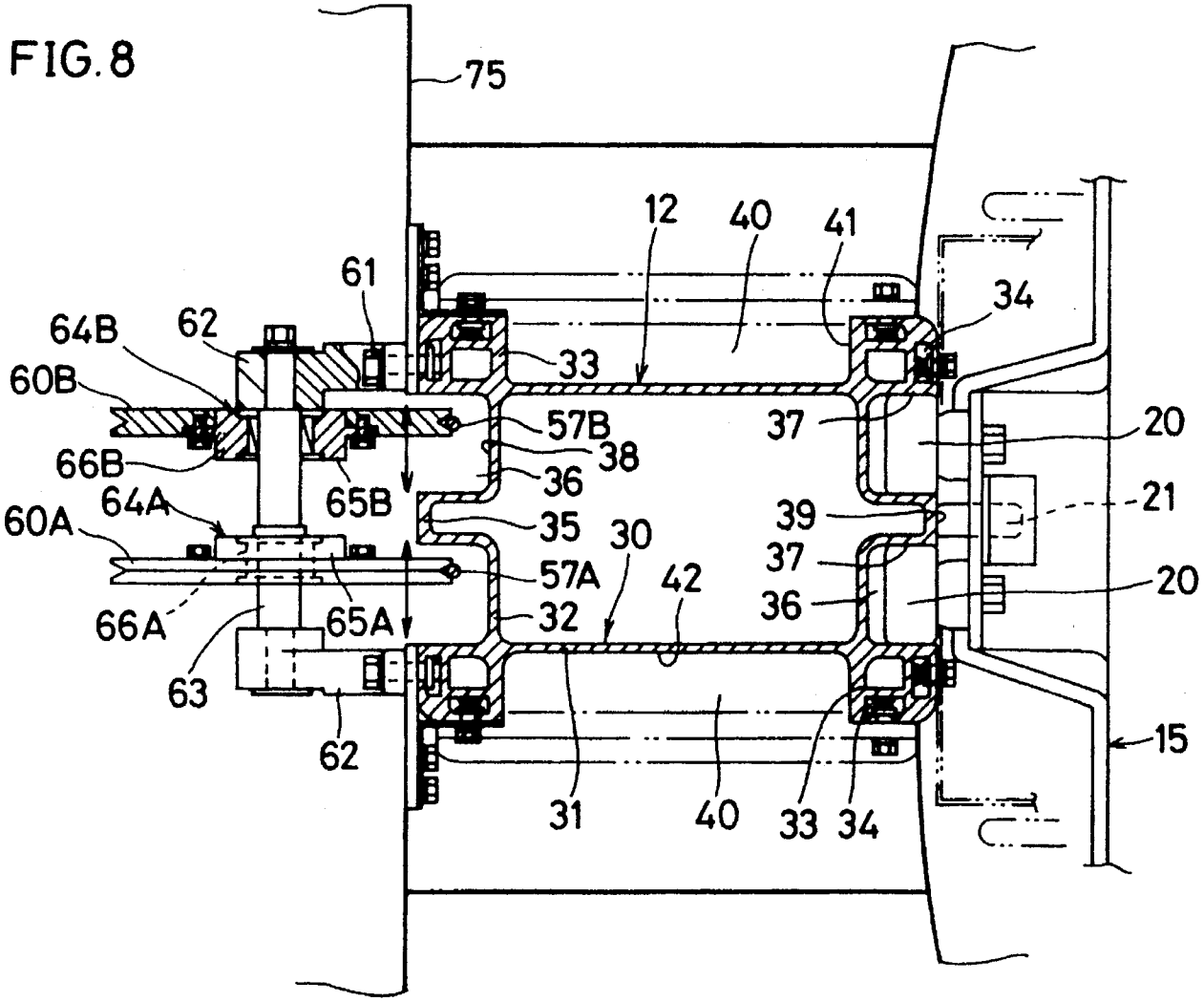
FIG. 8 is a cross-sectional plan of mechanical structure incorporating lower guide wheels secured to the delivery device usable for an automated warehouse shown in FIG. 1.

According to the second embodiment shown in FIGS. 8 and 9, lifting and lowering movement of the carriage 81 is smoothly executed without accidentally swinging itself by guiding the external front-rear swing preventive roller 82 onto the second external front-rear-directional guide surface 39, by guiding the internal right-left-directional swing preventive rollers disposed in the right-left direction onto a pair of internal right-left-directional guide surfaces 41, and also by guiding the internal right-left-directional swing preventive rollers 84 disposed in the right-left direction onto a pair of internal right-left-directional guide surfaces 42. In consequence, even when the internal front-rear-directional swing preventive rollers 83 forcibly hit against a pair of front-rear-directional guide surfaces 41 outside of the right-left direction Y, owing to reinforcing structure formed by rectangular rods of a projected corner-rod unit 33, no distortion can be generated.

In the first and second embodiments of the invention described above, a pair of rectangular struts having long-side members 31 have been introduced to the delivery device 10 comprising a pair of struts 12 and a square strut 12 has been introduced to the delivery device 80 comprising a single strut 12. However, the invention may also provide such an embodiment by providing the former delivery device 10 with a pair of square struts 12 and by providing the latter delivery device 80 with a single rectangular strut 12 having long-side members 31. In the first and second embodiments described above, the carriage 15 is lifted and lowered by means of the elevator drive unit 50 using the wires 57A and 57B. However, the invention may also be embodied by lifting and lowering the carriage 15 by means of the elevator drive unit 50 using a plurality of endless chain units.

Figure 11:
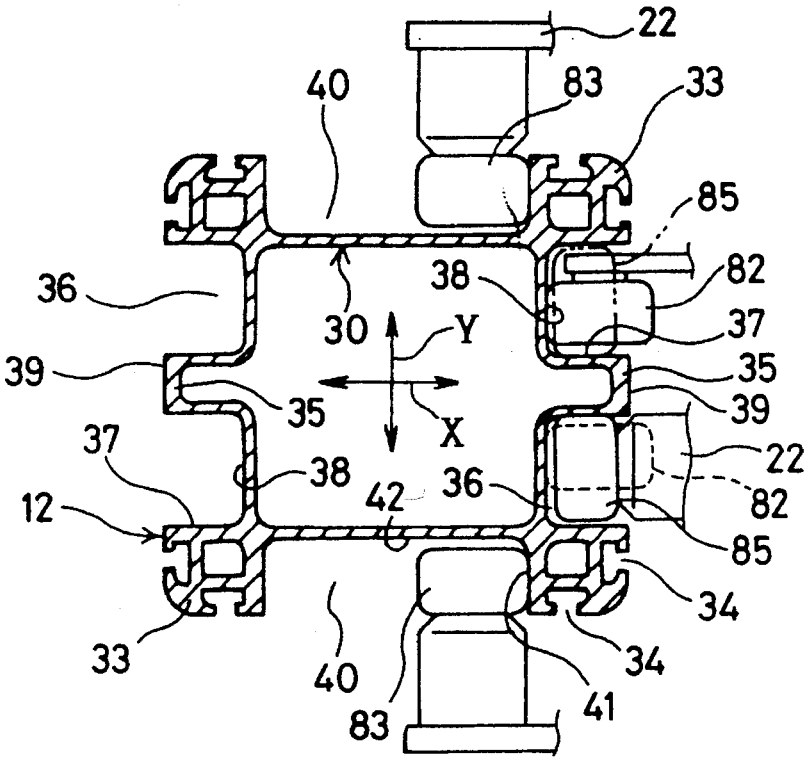
FIG. 11 is a cross-sectional plan of strut mechanism of the delivery device usable for an automated warehouse according to the third embodiment of the invention.

FIG. 11 illustrates the third embodiment of the invention as an exemplified variation from the preceding second embodiment shown in FIGS. 9 and 10. According to the third embodiment of the invention, lifting and lowering movement of the carriage 81 can be executed very smoothly without accidentally swinging itself under guidance of a strut 12 by way of guiding an external front-rear-directional swing-preventive roller 82 onto an external first front-rear-directional guide surface 38, by way of guiding an external right-left-directional swing preventive roller 85 onto an external right-left-directional guide surface 37, and also by way of guiding a pair of internal front-rear-directional swing preventive rollers 83 aligned in the right-left direction Y onto a pair of internal front-rear-directional guide surfaces 41. Even when the external right-left-directional swing preventive roller 85 forcibly hits against the external right-left-directional guide surface 37 disposed outside of the front-rear direction X, and yet, even when the internal front-rear-direction swing preventive rollers 83 forcibly hit against the internal front-rear-directional guide surfaces 41 disposed outside of the right-left direction Y, owing to reinforcing structure formed by rectangular rods of the projected corner rod unit 33, no distortion can be generated.

Figure 12:
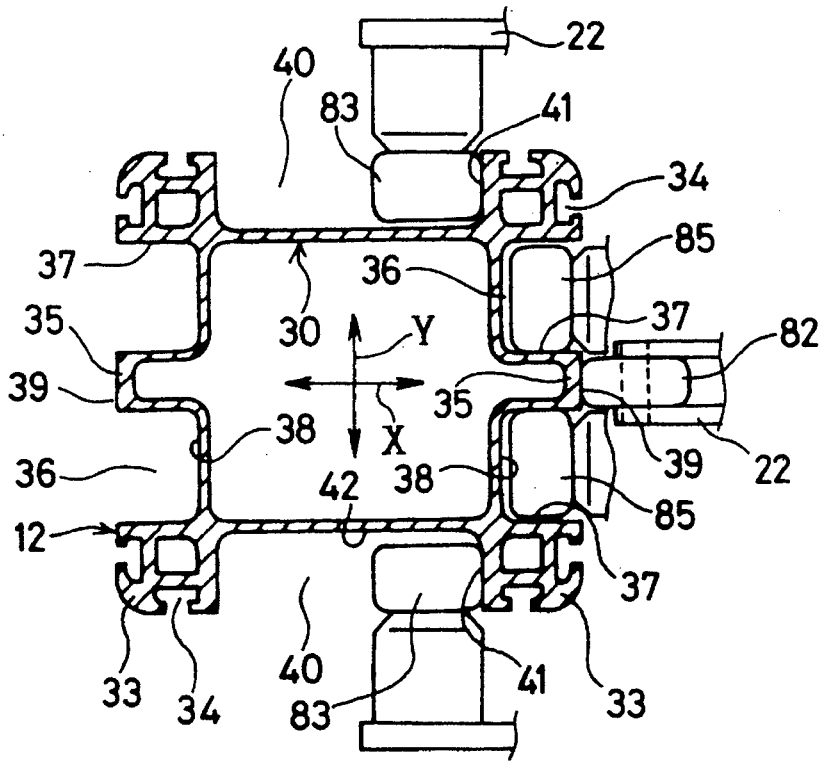
FIG. 12 is a cross-sectional plan of strut mechanism of the delivery device usable for an automated warehouse according to the fourth embodiment of the invention.

FIG. 12 illustrates the fourth embodiment of the invention as another exemplified variation from the second embodiment shown in FIGS. 9 and 10. According to the fourth embodiment, lifting and lowering movement of the carriage 81 can be executed very smoothly without accidentally swinging itself under guidance of a strut 12 by way of guiding an external front-rear-directional swing preventive roller 82 onto an external first front-rear-directional guide surface 38, by way of guiding a pair of internal front-rear-directional swing preventive rollers 85 aligned in the right-left direction Y onto a pair of internal front-rear-directional guide surfaces 37, and also by way of guiding a pair of internal right-left-directional swing preventive rollers 84 aligned in the right-left direction Y onto a pair of internal front-rear-directional guide surfaces 41.

Figure 13:
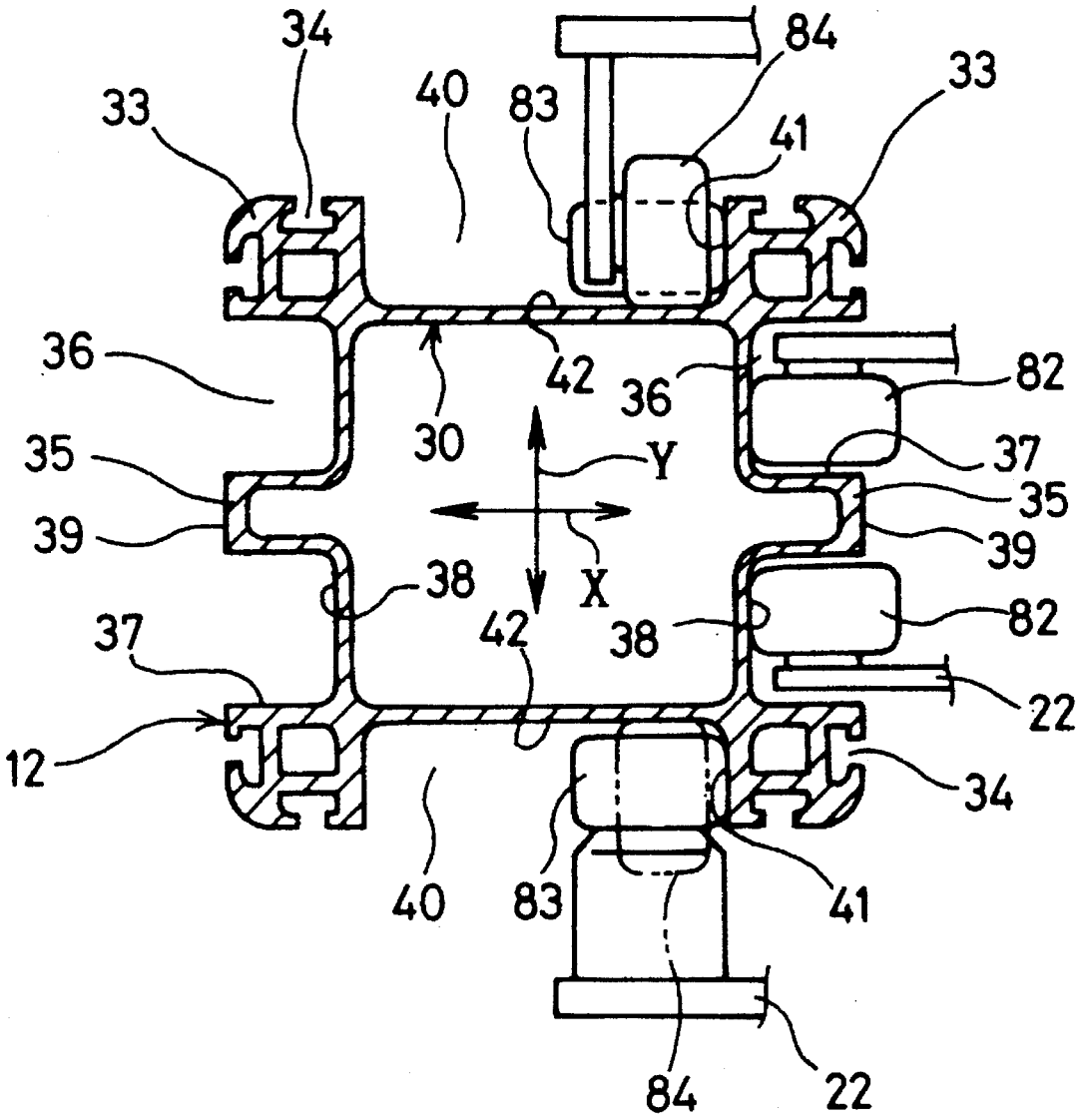
FIG. 13 is a cross-sectional plan of strut mechanism of the delivery device usable for an automated warehouse according to the fifth embodiment of the invention.
Figure 14:
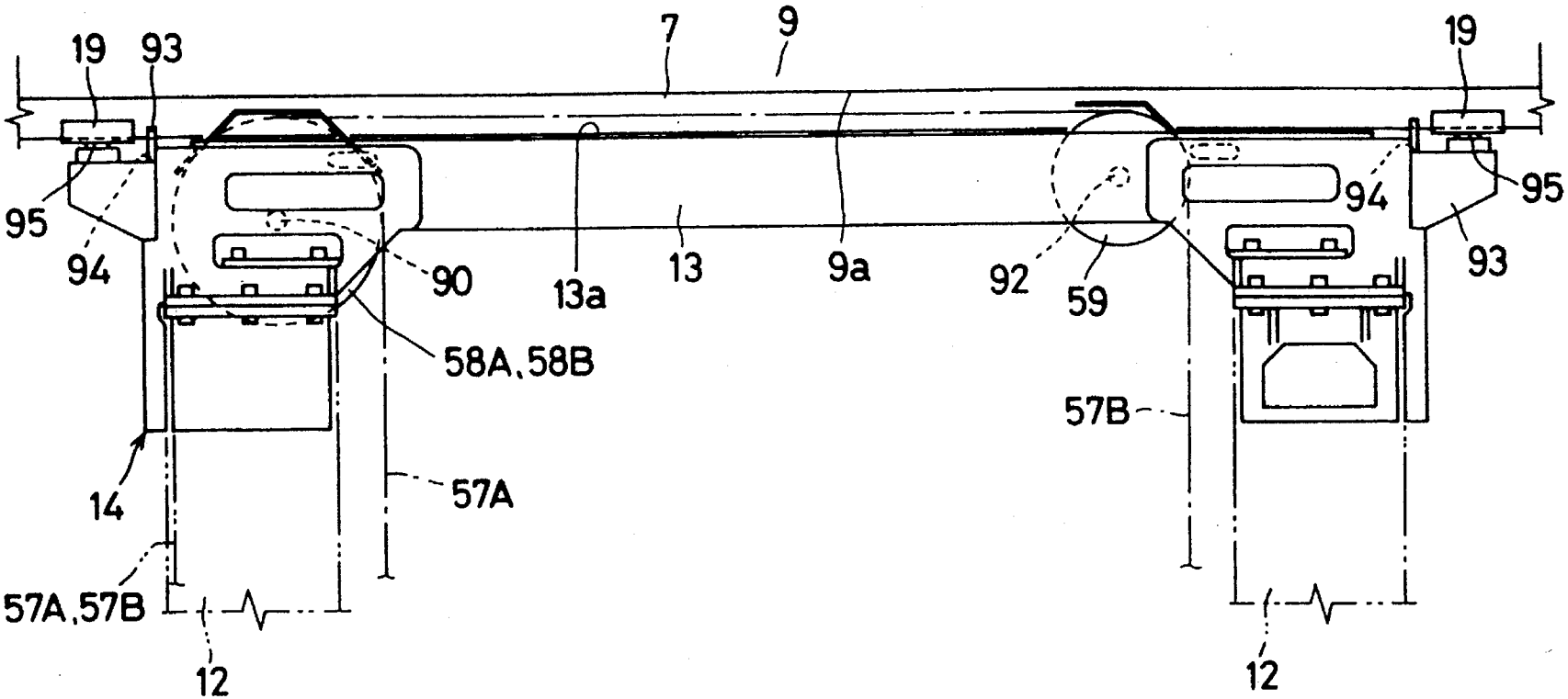
FIG. 14 is a lateral view of an upper frame structure provided for the delivery device usable for an automated warehouse according to the sixth embodiment of the invention.
Figure 15:
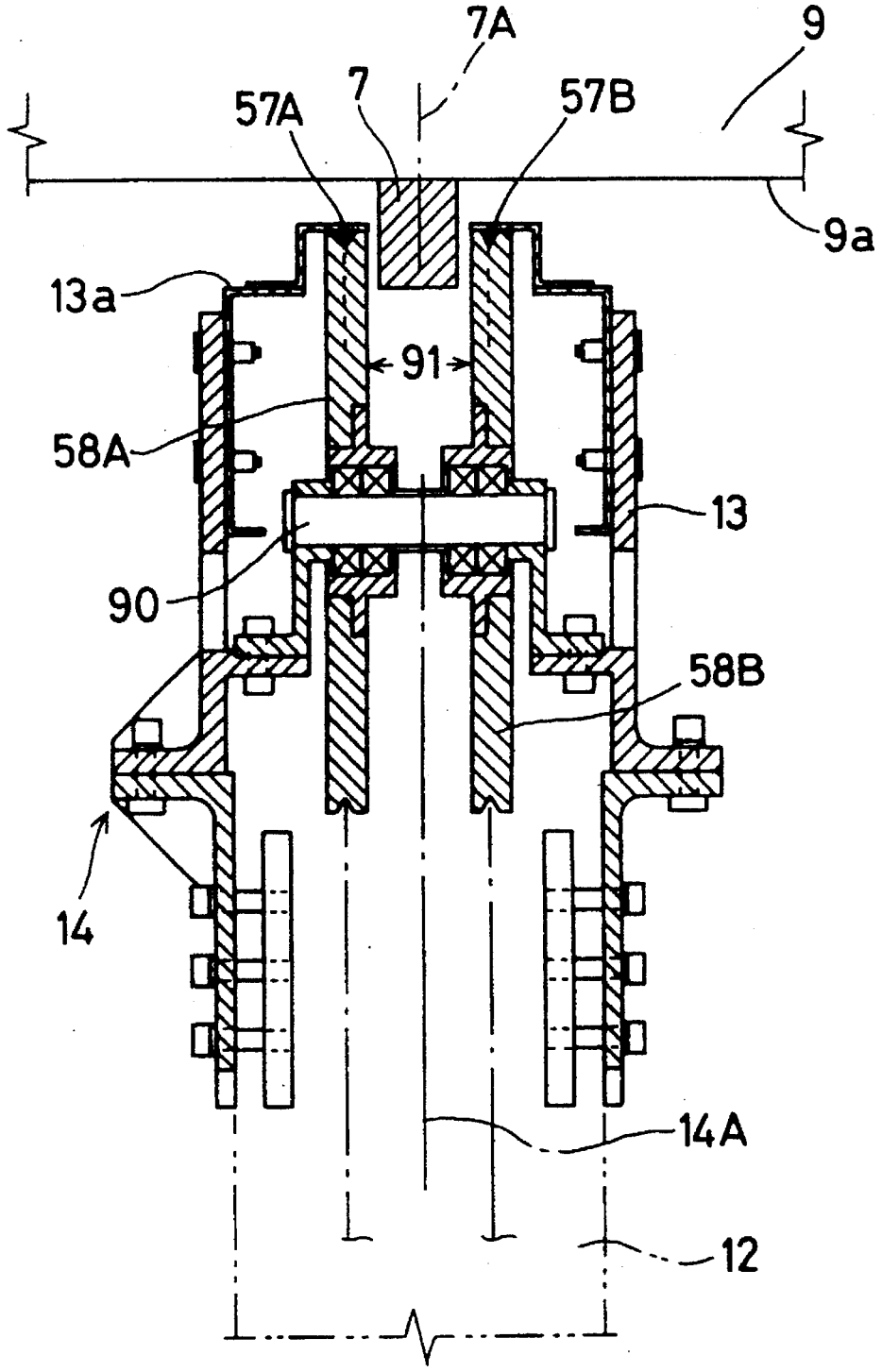
FIG. 15 is a vertical-sectional front view of base-side guide wheels in the upper frame structure provided for the delivery device usable for an automated warehouse related to the invention.
Figure 16:
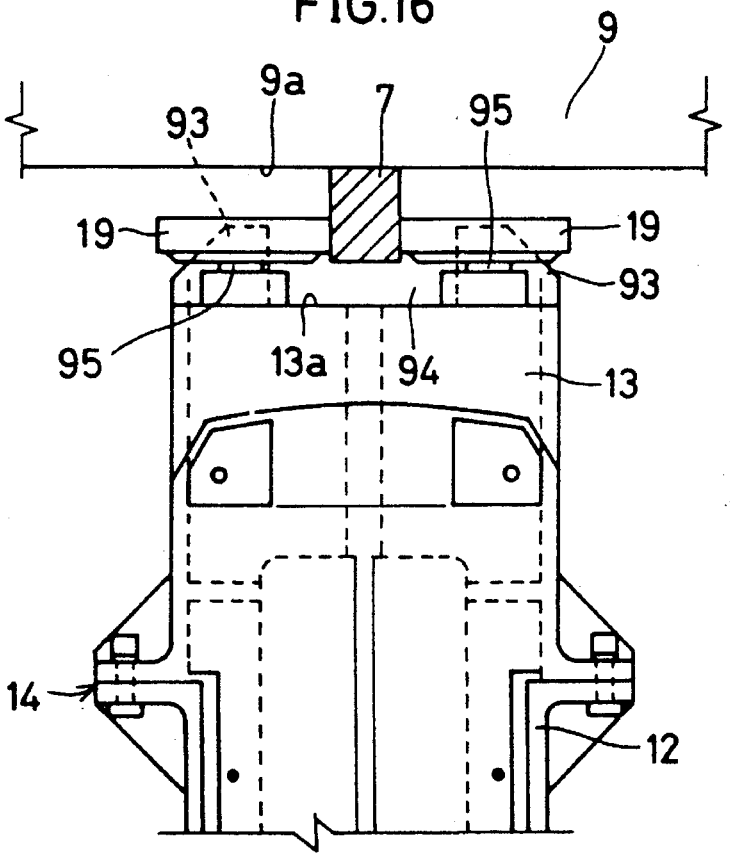
FIG. 16 is a front view of an upper guide roller provided for the delivery device usable for an automated warehouse related to the invention.
Figure 17:
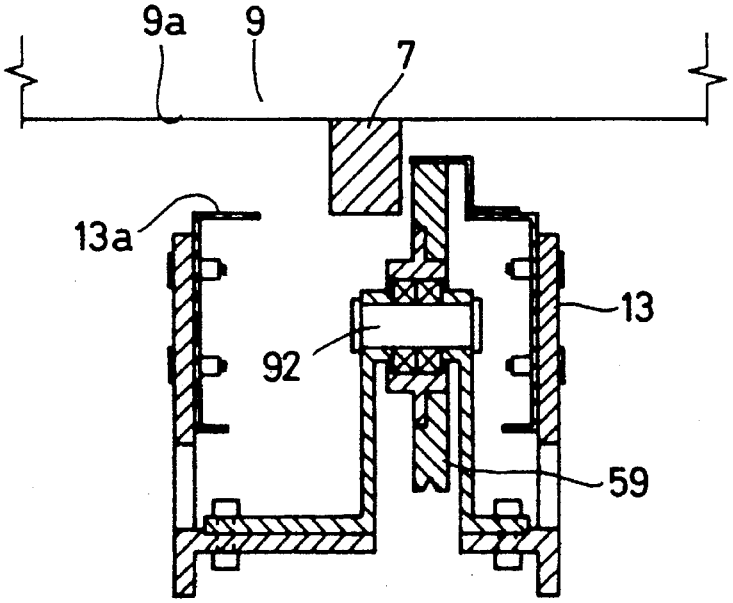
FIG. 17 is a vertical-sectional front view of an idler-side guide wheel in the upper frame structure provided for the delivery device usable for an automated warehouse related to the invention.

FIG. 13 illustrates the fifth embodiment of the invention as a still further exemplified variation from the second embodiment shown in FIGS. 9 and 10. According to the fifth embodiment, ascending and descending movement of the carriage 81 can also be executed very smoothly without accidentally swinging itself under guidance of a strut 12 by way of guiding an external front-rear swing preventive roller 82 onto an external first front-rear-directional guide surface 38, by guiding a pair of internal front-rear-directional swing preventive rollers 83 onto a pair of internal front-rear-directional guide surfaces 41, and also by way of guiding a pair of internal right-left-directional swing preventive rollers 84 aligned in right-left direction Y onto a pair of internal right-left-directional guide surfaces 42.

The first through fifth embodiments of the invention described above have respectively introduced rectangular rods for composing the projected corner-rods 33 externally projecting themselves in the front-rear and right-left directions. However, the invention may also provide plate-form corner rods 33 projecting themselves in the front-rear and right-left directions. Although the strut 12 has cross section being symmetric in the front-rear and right-left directions, the cross section may not necessarily be symmetric, but partial deformation or addition of other components to part of the strut 12 is also possible.

FIGS. 14 through 17 respectively illustrate the sixth embodiment of the delivery device according to the invention. A pair of wire units 57A and 57B led from a pair of lower guide wheels 60A and 60B respectively elongate themselves upwards before being wound on a pair of large-diametral upper guide wheels (i.e., base-side guide rollers) respectively being aligned in the right-left direction and secured to an upper frame structure 13. The large-diametral upper guide wheels 58A and 58B are rotatably secured to a shared base-side wheel-shaft 90 secured to the upper frame structure 13, where the large-diametral upper guide rollers 58A and 58B are discretely disposed to the left and to the right across the center 14A of a movable main body 14. In consequence, clearance 91 capable of accommodating a ceiling rail unit 7 is formed between internal surfaces of the opposite upper guide wheels 58A and 58B.

The large-diametral upper guide wheels 58A and 58B are respectively so disposed that the upper portions of the guide wheels slightly project themselves from the top surfaces 13*a* of the upper frame structure 13. Thus, the bottom surface 9*a* (or ceiling surface) of a beam member 9 securing the ceiling rail unit 7 thereto and the top surfaces 13*a* of the upper frame structure 13 can sufficiently gain access to each other.

The first wire unit 57A wound on the large-diametral upper guide diametral upper,guide wheels 58A is initially elongated downward before being linked with the carriage 15. The second wire unit 57B wound on the other large-diametral upper guide wheels 58B is initially wound on a small-diametral upper guide wheel (i.e., a free-side guide wheel) 59 secured to the upper frame structure 13 on a side remote from an elevator drive unit 50. After being elongated downward, the second wire unit 57B is linked with the carriage 15.

The small-diametral upper guide wheel 59 is secured to a free-side wheel shaft 92 secured to the upper frame structure 13 by way of freely rotating itself. The upper guide wheel 59 is disposed by way of being displaced on the other side of the center 14A of the movable main body 14, in other words, being opposite from the other surface of the ceiling rail unit 7. The upper portion of the small-diametral upper guide wheel 59 also slightly projects itself from the top surface 13*a* of the upper frame structure 13.

A pair of fall-preventive members 93 and 93 are secured to right-left-directional both-side end surfaces of the upper frame structure 13 above thee movable main body 14. Recessed clearance 94 for accommodating the ceiling rail unit 7 is formed between the both-side fall-preventive members 93 and 93 by way of upwardly being open. A pair of guide rollers 19 and 19 nipping the ceiling rail unit 7 are rotatably secured via a pair of vertical shafts 95 and 95 to the front-rear external sides of the both-side fall-preventive members 93 facing the recessed domain 94. According to the sixth embodiment of the invention shown in FIGS. 14 through 17, since the center 14A of the movable main body 14 correctly matches the center 7A of the ceiling rail unit 7, the delivery device 10 can easily be installed.

When the movable main body 14 moves on, the guide rollers 19 on both sides are guided to the ceiling rail unit 7 having the center 7A exactly matching the center 14A of the movable main body 14. In consequence, even when stopper action is generated as a result of intense contact of the guide rollers 19 with the ceiling rail unit 7 caused by biased load occurred in the course of inward and/or outward delivery of load by protruding a delivery instrument 16 in lateral direction for example, impact force merely concentrates onto the center portions 14A and 7A without being dispersed, and thus, the movable main body 14 can hardly incur distortion.

Furthermore, when stopper action is generated, connecting members (i.e., root portions) of the fall-preventive members 93 connected to the guide rollers 19 cannot be affected by substantial bending moment, and thus, the connection cannot be broken off. For example, even when the guide rollers 19 are damaged, the fall-preventive members 93 respectively come into contact with lateral surfaces of the ceiling rail unit 7, thus securely preventing the movable main body 14 from falling down to the left or to the right.

Since the ceiling rail unit 7 is positioned between the large-diametral upper guide wheels 58A and 58B and alongside of an end of the small-diametral guide wheel 59, the delivery device 10 can smoothly move on itself without causing the upper guide wheels 58A, 58B, and 59 to collide or come into contact with the ceiling rail unit 7.

In the sixth embodiment of the invention described above, a pair of guide rollers 19 aligned in the right-left direction are respectively secured to the corresponding fall-preventive members 93. However, the invention may also provide such an embodiment by way of discretely securing the fall-preventive members 93 and the guide rollers 19 onto upper portion of the movable main body 14.

Figure 18:
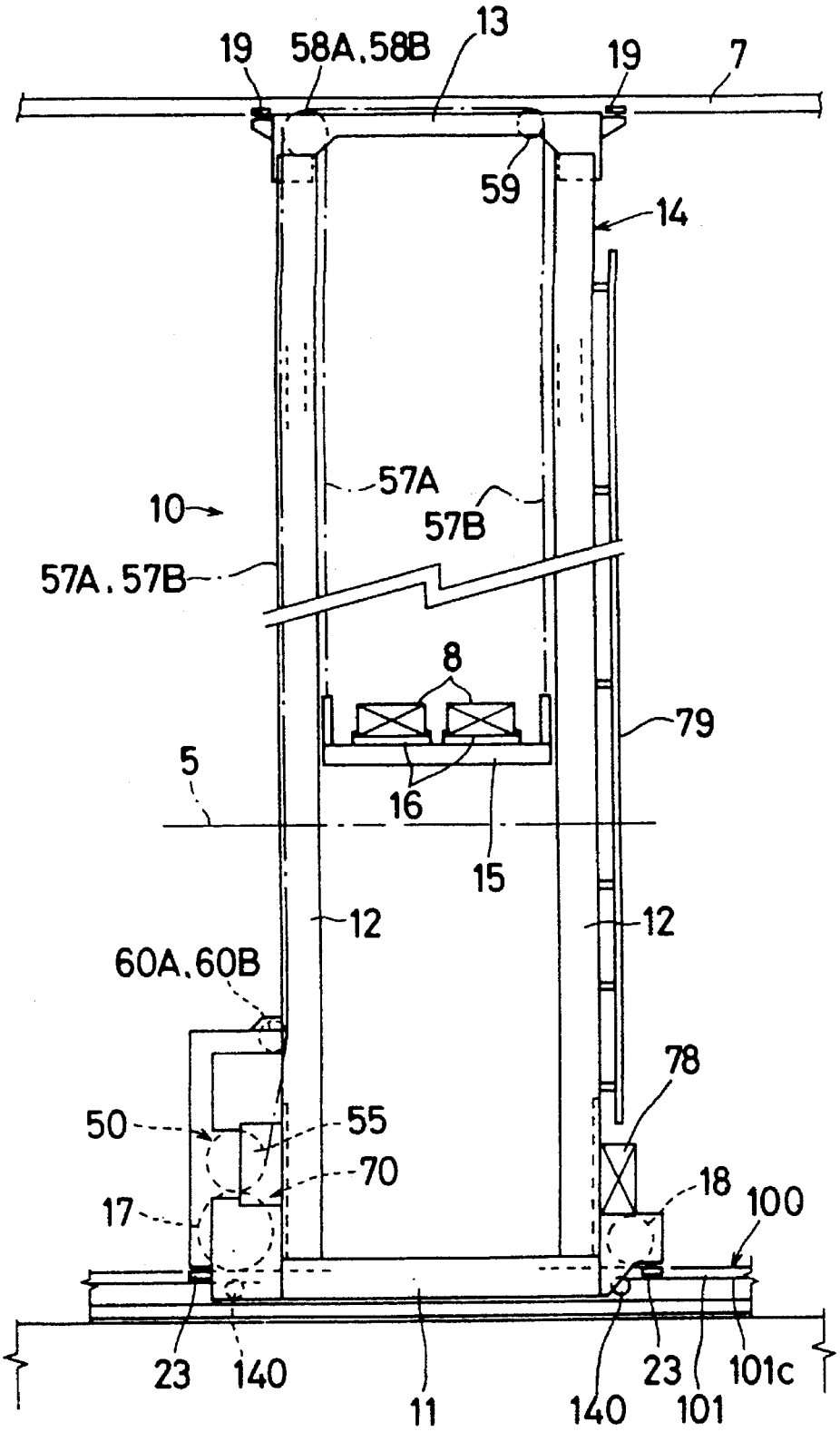
FIG. 18 is a partially exposed lateral view of the delivery device usable for an automated warehouse according to the seventh embodiment of the invention.
Figure 19:
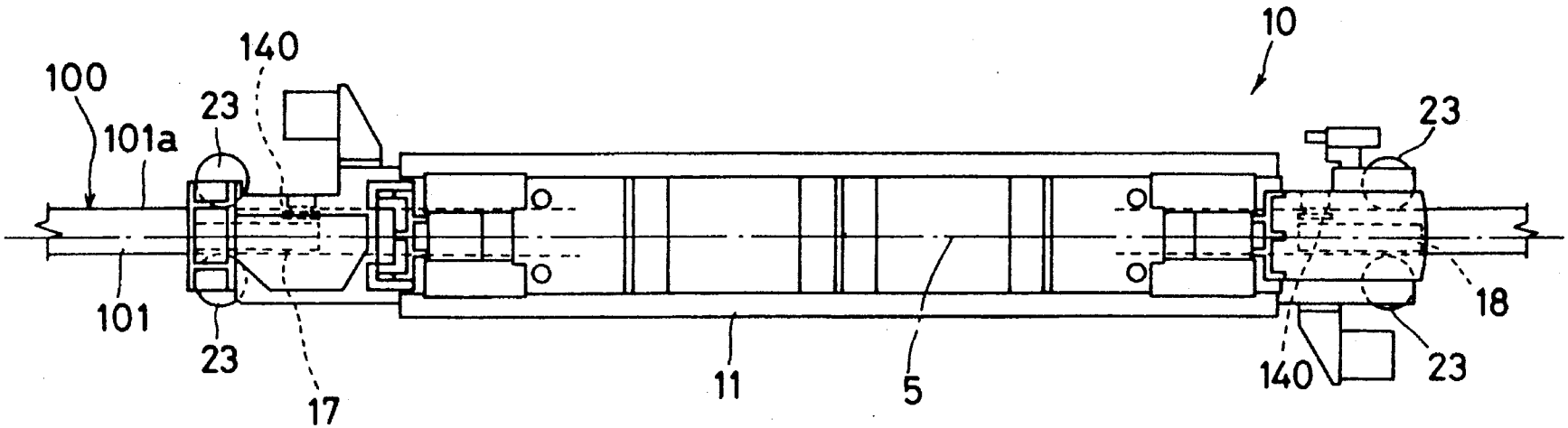
FIG. 19 is a plan of a bottom frame structure provided for the delivery device usable for an automated warehouse related to the invent ion.
Figure 20:
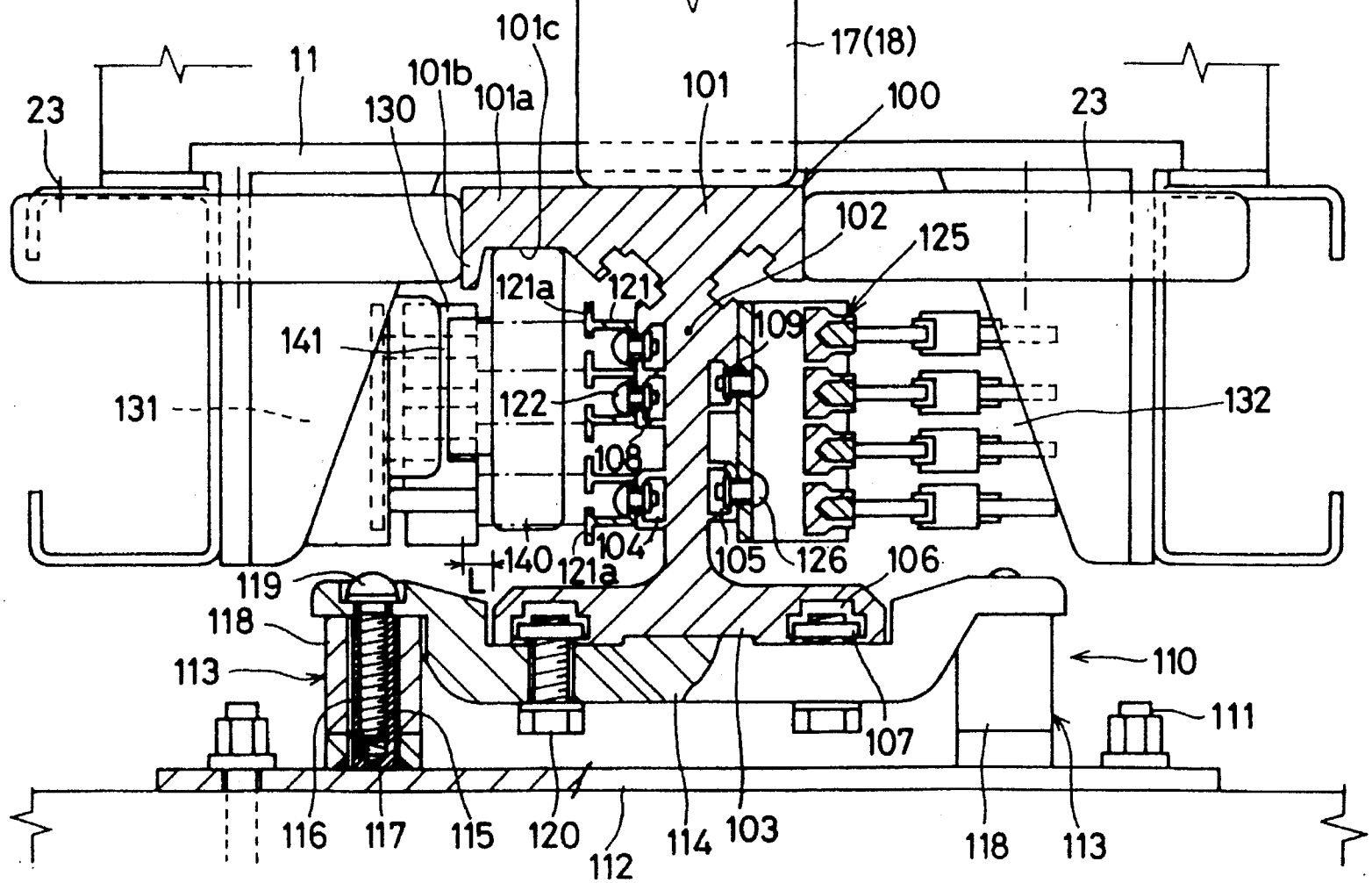
FIG. 20 is a partially exposed front view of a floor rail unit installed in the automated warehouse related to the invention.

FIGS. 18 through 20 respectively illustrate the seventh embodiment of the invention.

A drive wheel 17 and a follower wheel 18 respectively being supported and guided by a floor rail unit 100 are discretely secured to a bottom frame structure 11 in the front and rear locations. In addition, pair of bottom guide rollers 23 respectively being guided to the floor rail unit 100 are discretely disposed in the front and rear locations.

The floor rail unit 100 has I-shaped cross section formed by the following; an upper flange 101 permitting the drive and follower wheels 17 and 18 to come into contact therewith from the upper portion and the bottom guide rollers 23 to respectively face therewith from both sides; a web member 102 installed in the vertical direction; and a bottom flange 103. A plurality of fixing members 104 and 105 each being provided with dovetail-groove-form opening one side are projectively set to both-side surfaces of the web member 102 in the vertical direction. A pair of recessed dovetail-groove-form coupling members 106 open to the bottom are respectively formed in the right-left direction on the bottom surface of the bottom flange 103. The floor rail unit 100 is produced by molding aluminium for example. The fixing members 104 and 105 and the coupling members 106 are integrally molded in the course of molding the floor rail unit 100.

One of surfaces of the upper flange 101 of the floor rail unit 100 is formed into a projected flange 101*a* outwardly projecting itself beyond a predetermined range for securing detectable objects to be described later on. A downwardly extended rod member 101*b* is formed on a side edge of the projected flange 101*a*. The side edge of the projected flange 101*a* is formed by way of externally protruding itself by a predetermined length L from the side edge of the bottom flange 103. The bottom surface of the projected flange 101*a* being the inside surface of the downwardly extended rod member 101*b* is formed to serve itself as a fall-preventive roller receptive surface 101*c*.

The floor rail unit 100 consisting of the above structural components is secured on floor via a plurality of floor-rail supporting units 110 installed on floor at predetermined intervals. Each floor-rail supporting unit 110 consists of an anchor base 112 secured on floor via an anchor bolt 111 and a bracket 114 disposed on the anchor base 112 via a connector 113 capable of adjusting vertical position by operating screw means. The floor rail unit 100 is secured on the bracket 114.

A plurality of connectors 113 respectively incorporate a cylindrical body 115 erected on the anchor base 112, where a pair of cylindrical bodies 115 are aligned in the right-left direction. External threads 115 and internal threads 117 are formed in each cylindrical body 115. The bracket 114 is secured on a pair of nut bodies 118 screwedly coupled with each external threads 116. Each bolt 119 is downwardly coupled with a corresponding bolt-hole formed at an end of the bracket 114 by screwedly being engaged with the internal threads.

When building up the above structure, initially, the bracket 114 is mounted on the corresponding nut bodies 118, and then the corresponding bolts 119 are downwardly inserted in the respective bolt-holes to be coupled with the internal threads 117 by a predetermined amount. Next, the nut bodies 118 coupled with external threads 116 are shifted upwards, and then the bracket 114 is nipped by heads of the bolts 119 and the nut bodies 118. In consequence, the bracket 114 is secured at a predetermined height level against floor surface by means of respective connectors 113. A pair of plate-nuts 107 are inserted in a pair of junction domains 106 in the bottom of the floor rail unit 100. A pair of bolts 120 are upwardly inserted in corresponding bolt holes formed in the intermediate portions of the bracket 114. The floor rail unit 100 is eventually secured on the bracket 114 after securely coupling the bolts 120 with the corresponding plate nuts 107.

Likewise, plate nuts 108 and 109 are respectively inserted in the fixing members 104 and 105 formed on both-side surfaces of the web member 102. Thus, each run-control detectable object 121 facing a side surface of the web member 102 can be secured to a side surface of the web member 102 by screwably coupling a bolt 122 with the corresponding plate nut 108. A plurality of power-supply units 125 respectively facing surface on the other side of the web member 102 can be secured to the other-side surface thereof by screwably coupling respective bolts 126 with corresponding plate nuts 109 by externally inserting the bolts 126 therein.

The run-control detectable object 121 has L-shaped transverse section. After externally inserting the bolt 122 in a corresponding bolt hole formed on a side of the detectable object 121, the bolt 122 is screwably coupled with the plate nut 108 before securing the detectable object 121 to lateral surface of the floor rail unit 100. A vertical-directional broad-width domain is formed on a free end-surface of horizontal plane of the detectable object 121. Availing of external surface of the vertical-directional broad-width domain, a detectable surface 121*a* is formed by way of facing one side. The detectable object 121 is used for discontinuing high-speed and medium-speed run and for setting a predetermined position, where the detectable object 121 is secured to a predetermined position in the lengthwise direction of the floor rail unit 100.

A run-control detection device 130 is installed below the bottom frame structure 11 and the bottom guide roller 23. The detection device 130 freely faces the detectable surface 121*a* from lateral surface. The detection device 130 consists of a limited reflection type photoelectric tube unit for example, which is installed to inner surface of a bracket 131 secured to the bottom frame structure 11 by way of freely adjusting own position in lateral direction. A current collector unit 132 is disposed below the delivery device 10. A plurality of collector elements of the current collector unit 132 are disposed in vertical alignment in order that; they can slidably come into contact with corresponding rails of the power-supply unit 125.

A pair of fall-preventive roller 140 are provided near a pair of wheels 17 and 18 and below the delivery device 10, where the fall-preventive rollers 140 freely rotate themselves by way of freely coming into contact with the projected flange 101*a* from the bottom side. Concretely, a pair of right-left-directional roller shafts 141 are provided in the front and rear positions and on the part of the bottom frame structure 11. The fall-preventive rollers 140 are respectively secured to these roller shafts 141. The fall-preventive rollers 140 are so disposed that they can freely come into contact with the fall-preventive roller receptive surface 101c from the bottom side.

According to the seventh embodiment shown in FIGS. 18 through 20, running operation of the delivery device 10 can be executed very smoothly and stably in that the wheels 17 and 18 are supportedly led to the upper surface of the upper flange 101 and the lower guide rollers 23 are guided to right-left side surfaces of the upper flange 101. Furthermore, delivery of power and control signal to the delivery device 10 can smoothly be executed by causing a plurality of collector elements of the current collector unit 132 to slidably come into contact with corresponding rails of the power-supply unit 125. Furthermore, control of running operation of the delivery device 10 such as suspension of high-and-medium speed run and fixing of the delivery device at a predetermined position can properly be executed by causing the detection device 130 to detect the detectable surface 121*a* of the detectable object 121.

Since the projected flange 101*a* is disposed above and outside of the detectable surface 121*a* of the detectable object 121, dust of worn elements of the wheels 17/18 and the lower guide rollers 23 caused by their rotation or suspending dust fell from the top of the automated warehouse can hardly adhere to the detectable surface 121*a*, in other words, the detectable surface 121*a* can hardly be stained by dust.

As a result, the detectable surface 121*a* can maintain cleanness for a long while. This in turn permits the detection device 130 to precisely detect the detectable surface 12*a* all the time, and thus, the system operation including running of the delivery device can correctly and stably be controlled.

Furthermore, straight flow of dust from side edges of the projected flange 101*a* onto the detectable surface 12*a* can securely be prevented by the downwardly extended rod member 101*b* formed on the side edges of the projected flange 101*a*, thus inhibiting suspending dust from easily gaining access to the detectable surface 121*a*.

Furthermore, since the side edge of the projected flange 101*a* outwardly protrudes beyond the side edge of the lower flange 103, dust passed by side edges of the projected flange 101*a* can hardly deposit on the bottom flange 103, thus preventing dust on the bottom flange 103 from suspending upward to adhere to or deposit on the detectable surface 121*a*.

In the event that either of the wheels 17 and 18 is about to float itself from the floor rail unit 100 on receipt of impact stress generated by acceleration, deceleration, high-speed run, or sudden stop of the running operation of the delivery device in emergency, the fall-preventive rollers 140 disposed near the wheels 17 and 18 quickly come into contact with the fall-preventive roller receptive surface 101c from the bottom side, thus effectively preventing the wheels 17 and 18 from floating themselves to eventually prevent the delivery device 10 itself from running off the route or incurring overturn.

According to the seventh embodiment shown in FIGS. 18 through 20, a downwardly extending rod member 101*b* is formed on the side edge of the projected flange 101*a*. However, the invention may also provide such a floor rail unit 100 dispensing with the downwardly extended rod member 101*b*. The seventh embodiment of the invention provides side edge portion of the projected flange 101*a* by way of outwardly protruding beyond side edge of the bottom flange 103. The invention may also provide such a floor rail unit 100 that disposes the side edge portion of the projected flange 101*a* at an inward position from the side edge of the bottom flange 103. Although the seventh embodiment has introduced a detection device 130 comprising a limited reflection type photoelectric tube unit, the detection device 130 may also comprise a normal reflection type photoelectric tube unit.

What is claimed is:

1. A delivery device for use with an automated warehouse, which comprises a movable main body consisting of a bottom frame structure supported and guided by a floor rail unit via guide wheels and at least one strut erected on said bottom frame structure and guided at its upper end by a ceiling rail unit, a carriage disposed in the running direction of said movable main body and guided by said strut to be capable of freely ascending and descending along one surface of said strut, and an elevator drive unit for ascending and descending the carriage by way of winding and unwinding wires, characterized in that:

said elevator drive unit is disposed at a lower part of the strut in the running direction on the opposite side to the carriage;

said wires from the elevator drive unit are linked to the carriage via a pair of upper guide wheels provided at the top portion of the movable main body;

said elevator drive unit consists of a drum being opposite to the strut and an elevator driver disposed on one side of the drum in the orthogonal direction; and a running drive unit linked to a pair of running wheels is disposed on the other side of the drum in the orthogonal direction.

2. A delivery device for use with an automated warehouse as set forth in claim 1, wherein the strut is formed with a pair of outwardly open front-and-rear grooves in the vertical direction on the opposite side to the carriage in the running direction, and said strut is provided with a pair of lower guide wheels at the upper portion of the elevator drive unit and accommodates the wires stretched between said pair of lower guide wheels and said upper guide wheels in said front-and-rear directional grooves.

3. A delivery device for use with an automated warehouse as set forth in claim 2, wherein the elevator drive unit comprises a drum rotatable on an axis in the orthogonal direction to the running direction, and the wires from said drum are respectively stretched from the lower guide wheels to the upper guide wheels and then linked to the carriage, said lower guide wheels being freely movable along said axis in the orthogonal direction.

4. A delivery device for use with an automated warehouse as set forth in claim 3, wherein the pair of lower guide wheels are rotatably supported by a supporting shaft via a pair of bearings, said bearings being capable of reciprocating the lower guide wheels along said axis in the orthogonal direction by force of the wires generated by winding and unwinding the wires by means of the drum.

5. A delivery device for use with an automated warehouse as set forth in claim 2, wherein said strut is provided with a cover for covering from outside the wires stretching from the lower guide wheels to the elevator drive unit.

6. A delivery device for use with an automated warehouse as set forth in claim 2, wherein said strut is provided with a cover for covering the openings of the outwardly open grooves formed on the orthogonal directional surfaces.

7. A delivery device for use with an automated warehouse as set forth in claim 1, comprising a pair of struts disposed in the running direction, a carriage disposed between struts, and a plurality of wires discretely linked to the carriage in the running direction.

8. A delivery device for use with an automated warehouse as set forth in claim 1, comprising a single strut and at least one wire.

9. A delivery device fix use with an automated warehouse, which comprises a movable main body consisting of a bottom frame structure supported and guided by a floor rail unit via guide wheels and at least one strut erected on said bottom frame structure and guided at its upper end by a ceiling rail unit, a carriage disposed in the running direction of-said movable main body and guided by said strut to be capable of freely ascending and descending along one surface of said strut, and an elevator drive unit for ascending and descending the carriage by way of winding and unwinding wires, characterized in that:

said elevator drive unit is disposed at a lower part of the strut in the running direction on the opposite side to the carriage;

the wires from the elevator drive unit are linked to the carriage via a pair of upper guide wheels provided at the top portion of the movable main body;

said strut is formed with a pair of outwardly open front-and-rear grooves in the vertical direction on the opposite side to the carriage in the running direction;

said strut is provided with a pair of lower guide wheels at the upper portion of the elevator drive unit and accommodates the wires stretched between said pair of lower guide wheels and said upper guide wheels in said front-and-rear directional grooves, the strut has a rectangular cross section, a pair of orthogonal-directionally aligned grooves formed in the vertical direction on the surface opposite to the carriage in the running direction, a pair of running-directional grooves each formed in the vertical direction on both running-directional surfaces, a pair of orthogonal-directional swing-preventive guide surfaces formed with the orthogonal-directional surfaces of said pair of orthogonal-directionally aligned grooves, a pair of running-directional swing-preventive guide surfaces formed with the running-directional surfaces of said running-directional grooves, and corners formed as vertically extending members each having a rectangular cross-section, said corners respectively defining the orthogonal-directional swing-preventive guide surfaces and the running-directional swing-preventive guide surfaces.

10. A delivery device for use with an automated warehouse, which comprises a movable main body consisting of a bottom frame structure supported and guided by a floor rail unit via guide wheels and at least one strut erected on said bottom frame structure and guided at its upper end by a ceiling rail unit, a carriage disposed discretely in the running direction of said movable main body and guided by said strut to be capable of freely ascending and descending along one surface of said strut, and an elevator drive unit for ascending and descending the carriage by way of winding and unwinding a plurality of wires, characterized in that:

said plurality of wires from said elevator drive unit are wound on a plurality of guide wheels disposed at a plurality of positions in the orthogonal direction at the upper portion of the movable main body and then linked to the carriage, said guide wheels are disposed in the orthogonal direction discretely on both sides of the center of the movable main body in the orthogonal direction;

said guide wheels disposed discretely in the orthogonal direction are arranged to have a clearance therebetween substantial enough to accommodate the ceiling rail unit;

the upper portion of the movable main body is provided with a pair of guide rollers arranged in the orthogonal direction on both sides of the ceiling rail unit and fall-preventive members capable of accommodating the ceiling rail unit; and each of the fall-preventive members are provided with a pair of guide rollers arranged in the orthogonal direction on both sides of the ceiling rail unit.

11. A delivery device for use with an automated warehouse as set forth in claim 10, and further including a second strut, said struts are disposed in the running direction and linked at the upper ends by means of an upper frame structure; the carriage is disposed between the struts;

the pair of wires arranged in the orthogonal direction are wound on a pair of orthogonal-directional base-side guide wheels set to the upper frame structure on the side of the elevator drive unit;

subsequently, one of the orthogonal-directional wires on one side is linked to the carriage, whereas the other of the orthogonal-directional wires on the other side is wound on a free-side guide wheel set to the upper frame structure on the side remote from the elevator drive unit and then linked to the carriage;

said pair of base-side guide wheels are arranged to have a clearance therebetween; and said free-side guide wheel is disposed on the other side with respect to the center of the movable main body.

12. A delivery device for use with an automated warehouse as set forth in claim 10, comprising a single strut arranged to link the plurality of wires from the plurality of guide wheels to the carriage.

* * * * *